US009411261B2

(12) United States Patent
Kuriki et al.

(10) Patent No.: US 9,411,261 B2
(45) Date of Patent: Aug. 9, 2016

(54) DEVELOPER CARTRIDGE HAVING SPACER BETWEEN HOUSING AND LAYER THICKNESS REGULATION BLADE

(71) Applicant: Brother Kogyo Kabushiki Kaisha, Nagoya-shi, Aichi-ken (JP)

(72) Inventors: Hirofumi Kuriki, Nagoya (JP); Takashi Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/488,350

(22) Filed: Sep. 17, 2014

(65) Prior Publication Data

US 2015/0086249 A1 Mar. 26, 2015

(30) Foreign Application Priority Data

Sep. 20, 2013 (JP) ..... 2013-195349

(51) Int. Cl.
*G03G 15/08* (2006.01)

(52) U.S. Cl.
CPC ..... *G03G 15/0812* (2013.01)

(58) Field of Classification Search
CPC ..... G03G 15/0808; G03G 15/0812
USPC ..... 399/284
See application file for complete search history.

(56) References Cited

U.S. PATENT DOCUMENTS 8,712,296 B2 4/2014 Mori
2002/0110383 A1* 8/2002 Kikuchi et al. ..... 399/103
2005/0254862 A1* 11/2005 Toba et al. ..... 399/284
2009/0087217 A1* 4/2009 Norris ..... G03G 21/181 399/109
2009/0142108 A1* 6/2009 Blanck ..... G03G 15/0812 399/284
2011/0158708 A1 6/2011 Mori
2014/0086642 A1* 3/2014 Itabashi ..... G03G 21/1821 399/284
2014/0212183 A1 7/2014 Mori
2014/0270844 A1* 9/2014 Ishio ..... G03G 15/0812 399/109

FOREIGN PATENT DOCUMENTS

JP H11-231646 A 8/1999
JP 2001-331034 A 11/2001
JP 2011-150269 A 8/2011
JP 2012-058592 A 3/2012

* cited by examiner

*Primary Examiner* — Billy Lactaoen
*Assistant Examiner* — Arlene Heredia Ocasio
(74) *Attorney, Agent, or Firm* — Banner & Witcoff, Ltd.

(57) ABSTRACT

A cartridge include a housing configured to accommodate a developing agent therein, a developing agent carrying member configured to carry the developing agent, a layer thickness restricting member disposed between the housing and the developing agent carrying member and configured to restrict a layer thickness of the developing agent carried by the developing agent carrying member, and a spacer disposed between the housing and the layer thickness restricting member in a first direction in which the developing agent carrying member and the layer thickness restricting member face one another and in which is orthogonal to a longitudinal direction of the developing agent carrying member. The spacer includes a first engaged portion configured to be engaged. The layer thickness restricting member includes a first engaging portion configured to engage with the first engaged portion such that relative movement of the spacer and the layer thickness restricting member is restricted.

17 Claims, 20 Drawing Sheets

DEVELOPER CARTRIDGE HAVING SPACER BETWEEN HOUSING AND LAYER THICKNESS REGULATION BLADE

CROSS-REFERENCE TO RELATED APPLICATION

This application claims priority from Japanese Patent Application No. 2013-195349, filed on Sep. 20, 2013, which is incorporated herein by reference in its entirety.

TECHNICAL FIELD

Aspects disclosed herein relate to a cartridge used in an image forming apparatus which employs electrophotography.

BACKGROUND

There have been known electrophotographic printers where developing cartridges are detachably mounted. Such known developing cartridges detachably mounted to a printer include a developing cartridge having a developing frame which accommodates toner, a developing roller which carries toner, and a member which regulates the thickness of a toner layer carried by the surface of the developing roller.

SUMMARY

The developing frame of this developing cartridge has a screwing portion, and the screwing portion, the layer thickness regulating member, and the developing roller are arrayed in a front/back direction. The screwing portion has protruding bosses arrayed toward the layer thickness regulating member, i.e., in the front/back direction, so as to fix the layer thickness regulating member to a housing.

Accordingly, in a case of attaching/detaching the layer thickness regulating member to/from the developing cartridge for maintenance or the like, the layer thickness regulating member is moved in the front/back direction so as to be engaged/disengaged with/from the bosses of the screwing portion. The developing roller has to be detached from the developing cartridge in order to move the layer thickness regulating member in the front/back direction.

That is to say, in order to attach/detach the layer thickness regulating member to/from the developing cartridge, the developing roller also has to be attached/detached, which is problematic in that the number of work steps increases.

Accordingly, it is an object of the present invention to provide a cartridge where the layer thickness regulating member can be easily replaced.

According to one or more aspects of the disclosure, a cartridge may include a housing configured to accommodate a developing agent therein, a developing agent carrying member configured to carry the developing agent, a layer thickness restricting member disposed between the housing and the developing agent carrying member and configured to restrict a layer thickness of the developing agent carried by the developing agent carrying member, and a spacer disposed between the housing and the layer thickness restricting member in a first direction in which the developing agent carrying member and the layer thickness restricting member face one another and in which is orthogonal to a longitudinal direction of the developing agent carrying member. The spacer may include a first engaged portion configured to be engaged. The layer thickness restricting member may include a first engaging portion configured to engage with the first engaged portion such that relative movement of the spacer and the layer thickness restricting member is restricted.

DETAILED DESCRIPTION

1. Overview of Developing Cartridge

Figure 1:
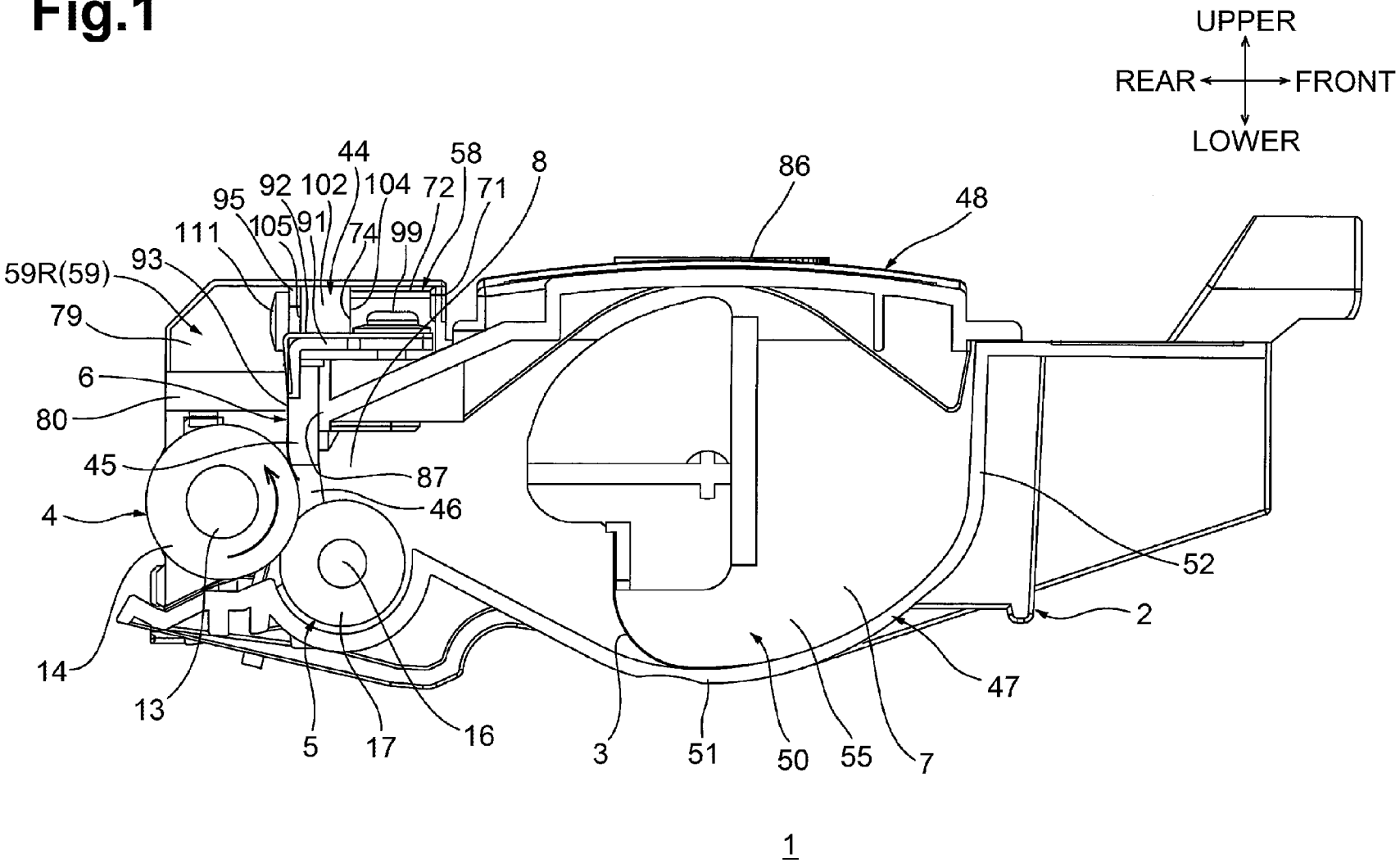
FIG. 1 is a cross-sectional view taken along the middle of a developing cartridge according to a first embodiment of a cartridge according to the present embodiment.

A developing cartridge 1 which is an example of a cartridge includes a developing frame 2 which is an example of a housing, an agitator 3, a developing roller 4 which is an example of a developing agent carrying member, a supply roller 5, and a layer thickness regulating blade 6 which is an example of a layer thickness restricting member, as illustrated in FIG. 1.

Note that in the following description, when referring to directions regarding the developing cartridge 1, the side of the developing roller 4 where the developing roller 4 is disposed will be referred to as the rear of the developing cartridge 1, and the opposite side thereof will be referred to as the front. That is to say in FIG. 1, the left side in the plane of the drawing is the rear, and the right side in the plane of the drawing is the front. The top side in the plane of the drawing is upwards, and the bottom side in the plane of the drawing is downwards. The terms "left" and "right" regarding the developing cartridge 1 refer to when viewing the developing cartridge 1 from the front. That is to say, the near side in the drawing in FIG. 1 is the left side, and the far side in the drawing is the right side. The front-back direction is one example of a first direction, with the direction toward the front being an example of one way in the first direction and the direction toward the back being an example of the other way in the first direction.

The developing frame 2 is in a generally box form extending in the left-right directions, with the rear end portion of the developing frame 2 opened in the front-back direction. The developing frame 2 includes a toner accommodation chamber 7 and a developing chamber 8 therein, disposed in parallel in the front-back direction. The toner accommodation chamber 7 accommodates toner, which is an example of developing agent.

The agitator 3 is disposed around the middle portion of the toner accommodation chamber 7 in the front-back and vertical directions.

The developing roller 4 is disposed at the rear end portion of the developing chamber 8. The developing roller 4 includes a developing roller shaft 13 and a rubber roller 14.

The developing roller shaft 13 has a generally cylindrical form extending in the left-right direction.

The rubber roller 14 has a generally cylindrical form, and covers the developing roller shaft 13 so that both the left and right end portions of the developing roller shaft 13 are exposed.

The developing roller 4 is supported by the developing frame 2, by the left and right end portions of the developing roller shaft 13 being rotatably supported by a pair of side walls 50, described later. The upper portion and rear portion of the rubber roller 14 of the developing roller 4 are exposed from the developing frame 2.

The supply roller 5 is disposed at the lower front side of the developing roller 4 within the developing chamber 8. The supply roller 5 includes a supply roller shaft 16 and a sponge roller 17.

The supply roller shaft 16 has a generally cylindrical form extending in the left-right direction.

The sponge roller 17 has a generally cylindrical form, and covers the supply roller shaft 16 so that both the left and right end portions of the supply roller shaft 16 are exposed.

The supply roller 5 is supported by the developing frame 2, by the left and right end portions of the supply roller shaft 16 being rotatably supported by the pair of side walls 50, described later. The upper rear portion of the sponge roller 17 of the supply roller 5 is pressed against the lower front portion of the rubber roller 14.

The layer thickness regulating blade 6 is disposed to the upper front of the developing roller 4 within the developing chamber 8. The layer thickness regulating blade 6 is supported by the developing frame 2 by way of later-described square spacers 44, so that the lower edge portion of the layer thickness regulating blade 6 comes into contact with the upper front portion of the rubber roller 14 of the developing roller 4.

2. Overall Configuration of Printer

Figure 2:
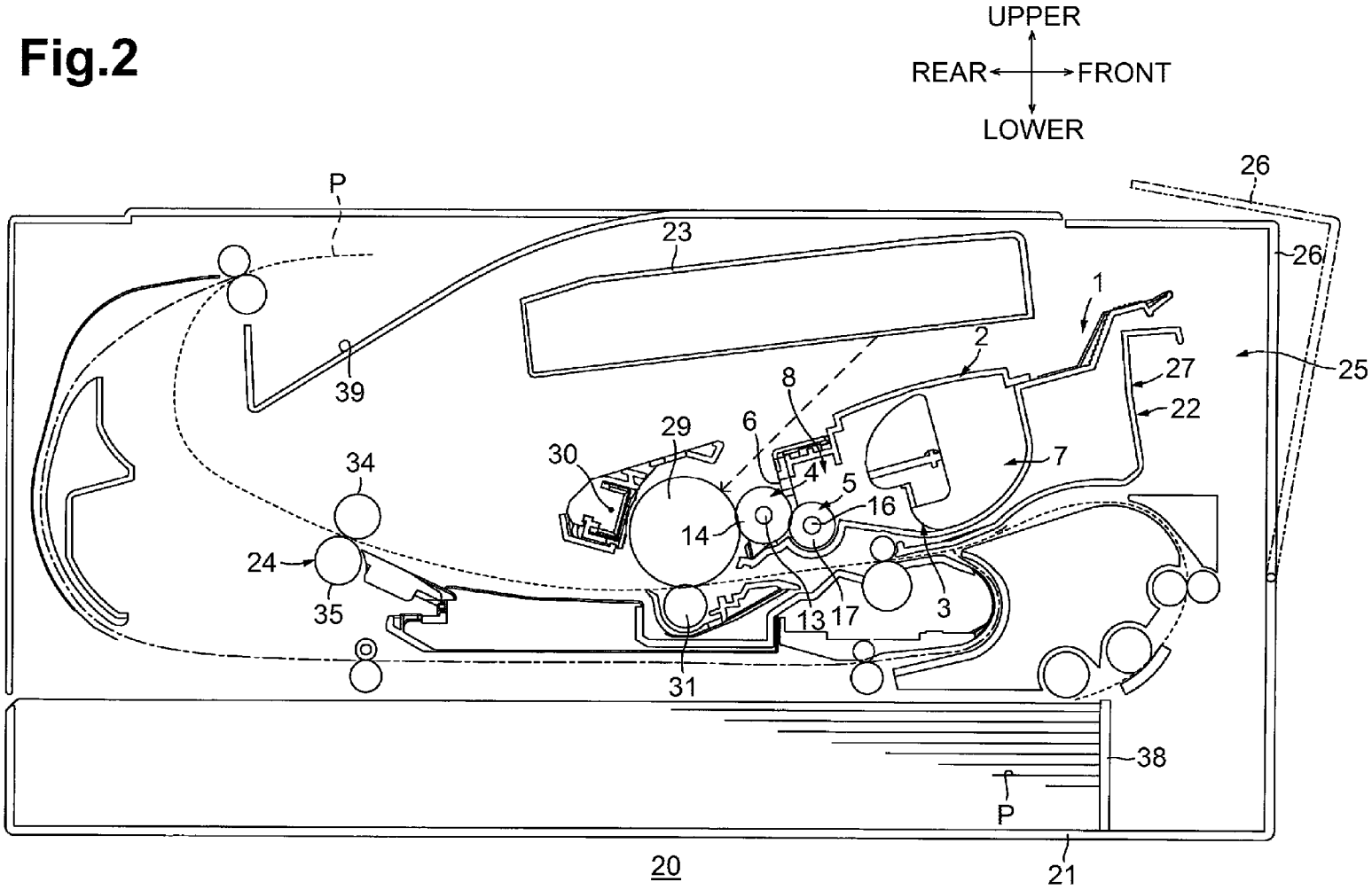
FIG. 2 is a cross-sectional view taken along the middle of a printer using the developing cartridge illustrated in FIG. 1.

A printer 20 is an electrophotographic black-and-white printer, as illustrated in FIG. 2. The printer 20 includes a main body casing 21, a process cartridge 22, a scanner unit 23, and a fixing unit 24.

The main body casing 21 has a general box shape. The main body casing 21 has an opening portion 25, a front cover 26, a sheet feed tray 38, and a sheet discharge tray 39.

The opening portion 25 is configured such that the front wall of the main body casing 21 is opened in the front-back direction, allowing passage of the process cartridge 22.

The front cover 26 has a general plate form, generally L-shaped in side view. The front cover 26 is supported by the lower edge thereof as a pivot so as to be capable of rocking as to the front wall of the main body casing 21. The front cover 26 is configured so as to open or close the opening portion 25.

The sheet feed tray 38 is disposed on the bottom within the main body casing 21, and is configured to store sheets P.

The sheet discharge tray 39 is disposed on the upper face of the main body casing 21.

The process cartridge 22 is configured to be mounted to and detached from the main body casing 21, via the opening portion 25. The process cartridge 22 includes a drum cartridge 27 and the aforementioned developing cartridge 1.

The drum cartridge 27 includes a photosensitive drum 29, a scorotron charger 30, and a transfer roller 31.

The photosensitive drum 29 is rotatably supported at the rear end of the process cartridge 22. The photosensitive drum 29 has a generally cylindrical form extending on the left-right direction.

The scorotron charger 30 is disposed behind the photosensitive drum 29, with spacing provided between the photosensitive drum 29 and scorotron charger 30.

The transfer roller 31 is disposed beneath the photosensitive drum 29. The top portion of the transfer roller 31 comes into contact with the bottom portion of the photosensitive drum 29.

The developing cartridge 1 is configured so as to be mounted to and detached from the drum cartridge 27. In a state where the developing cartridge 1 is mounted to the drum cartridge 27, the rearmost portion of the developing roller 4 comes into contact with the foremost portion of the photosensitive drum 29.

A scanner unit 23 is disposed above the process cartridge 22. The scanner unit 23 is configured to emit a laser beam toward the photosensitive drum 29, based on image data, as illustrated by a dashed line in FIG. 2.

The fixing unit 24 is disposed behind the process cartridge 22. The fixing unit 24 includes a heating roller 34, and a pressure roller 35 which is pressed against the lower rear portion of the heating roller 34.

Upon the printer 20 starting image forming operations under control of a control unit omitted from illustration, the scorotron charger 30 uniformly charges the surface of the photosensitive drum 29. Thereafter, the scanner unit 23 exposes the surface of the photosensitive drum 29. Thus, an electrostatic latent image based on the image data is formed on the surface of the photosensitive drum 29.

The agitator 3 stirs toner within the toner accommodation chamber 7, so as to be supplied to the supply roller 5. The supply roller 5 supplies the toner supplied from the agitator 3 to the developing roller 4. At this time, the toner is charged by friction to a positive polarity between the developing roller 4 and the supply roller 5, and is carried by the developing roller 4. The layer thickness regulating blade 6 regulates the thickness of the toner layer carried on the developing roller 4 to a constant thickness.

The toner carried by the developing roller 4 is then supplied to the electrostatic latent image on the surface of the photosensitive drum 29. Accordingly, a toner image is carried on the surface of the photosensitive drum 29.

Sheets P are fed one at a time from the sheet feed tray 38, at predetermined timings, by rotation of various rollers, and fed to the nip of the photosensitive drum 29 and transfer roller 31. The toner image on the photosensitive drum 29 is transferred to the sheet P when passing between the photosensitive drum 29 and the transfer roller 31.

Thereafter, the sheet P is heated and pressurized when passing between the heating roller 34 and the pressure roller 35. The toner image on the sheet P is thermally fixed to the sheet P at this time. Thereafter, the sheet P is discharged to the sheet discharge tray 39.

3. Detailed Description of Developing Cartridge

Figure 3A:
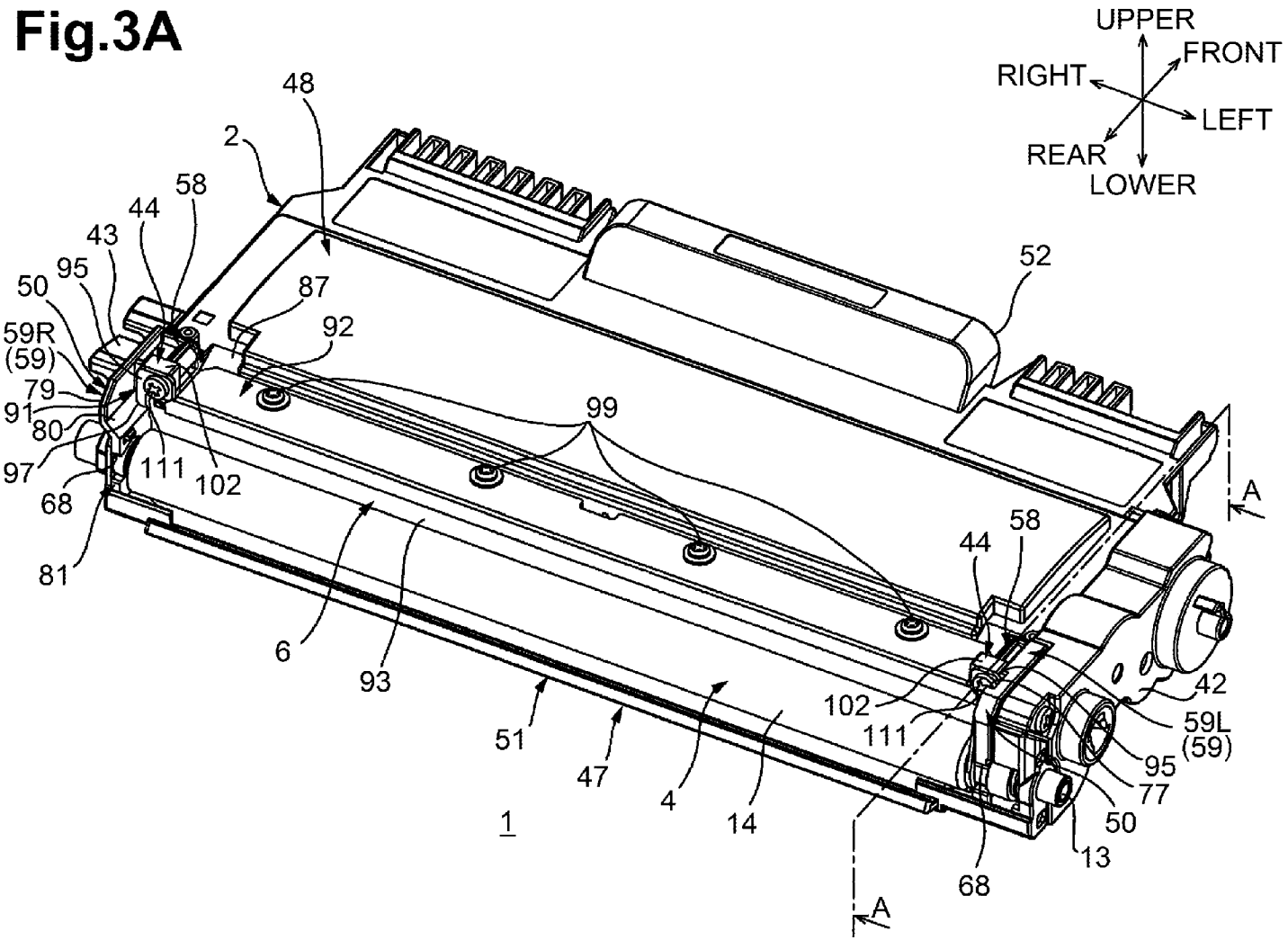
FIG. 3A is a perspective view of the developing cartridge illustrated in FIG. 1 as viewed from the left rear side.
Figure 3B:
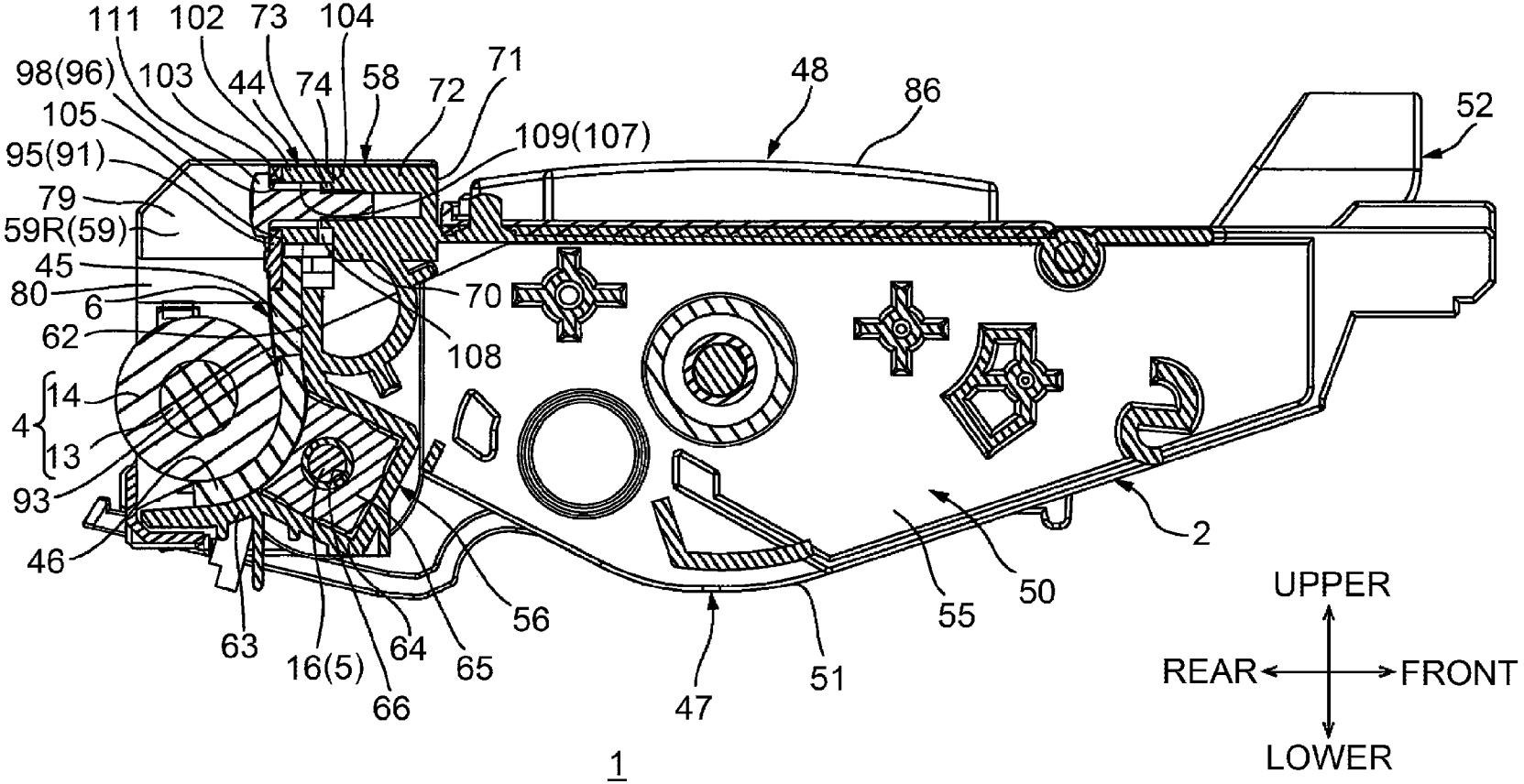
FIG. 3B is a cross-sectional view taken along line A-A in FIG. 3A.

The developing cartridge 1 includes the aforementioned developing frame 2, the aforementioned layer thickness regulating blade 6, a blade seal 45 which is an example of a seal member, side seals 46, and the square spacers 44 which are an example of spacers, as illustrated in FIGS. 3A and 3B.

Note that the developing cartridge 1 has a driving unit 42 to the left side of the developing frame 2. The driving unit 42 is configured so as to transmit driving force, from an unshown driving source of the main body casing 21, to each of the agitator 3, developing roller 4, and supply roller 5.

The developing cartridge 1 also has an electrode unit 43 to the right of the developing frame 2. The electrode unit 43 is configured so as to supply electric power from an unshown external power source to the developing roller 4 and the supply roller 5.

(1) Developing Frame

Figure 4:
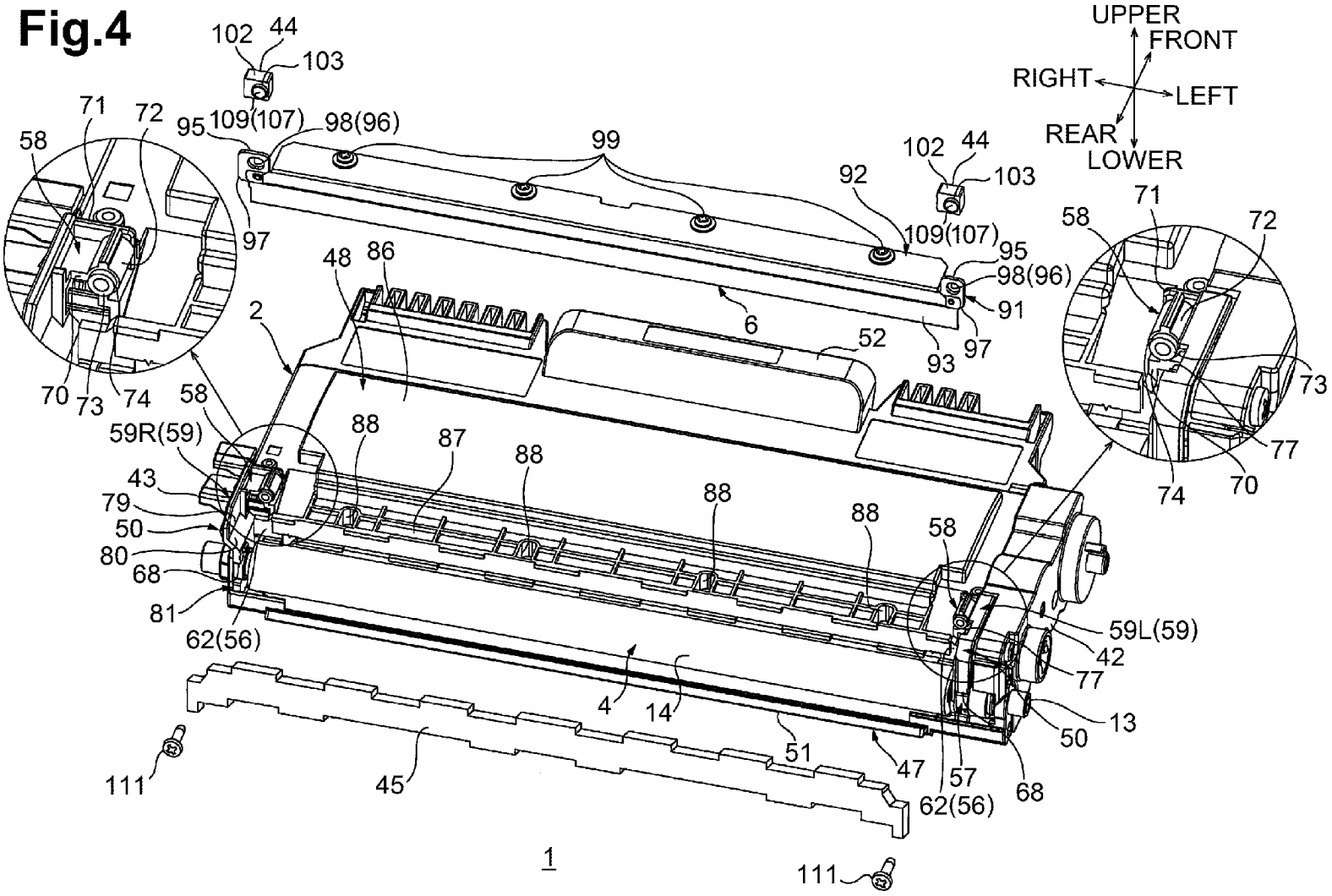
FIG. 4 is a disassembled perspective view of the developing cartridge illustrated in FIG. 1 as viewed from the left rear side.

The developing frame 2 has a base frame 47 and a cover frame 48, as illustrated in FIGS. 1 and 4.

The base frame 47 is formed as a frame having a bottom. The base frame 47 has the pair of side walls 50, a lower wall 51, and a front wall 52.

The pair of side walls 50 is disposed at the left and right edge portions of the base frame 47. Each side wall 50 in the pair has a main unit 55, a seal supporting unit 56, a spacer fixing portion 58 which is an example of a fixing portion, and a developing roller attaching portion 59, as illustrated in FIGS. 3B and 4.

The main unit 55 makes up the front half of the side walls 50. The main unit 55 is of a general plate form, generally rectangular in side view, and extends in the front-back direction.

The seal supporting unit 56 protrudes outwards to the left and right directions from the rear edge portion of the main unit 55, and extends vertically. Each seal supporting unit 56 includes a blade seal supporting portion 62, a side seal supporting portion 63, and a shaft seal supporting portion 64.

The blade seal supporting portion 62 is disposed above the seal supporting unit 56. The blade seal supporting portion 62 has a generally rectangular shape in frontal view.

The side seal supporting portion 63 extends downward from the blade seal supporting portion 62. The side seal supporting portion 63 extends continuously downward from the lower edge of the blade seal supporting portion 62, curves backwards following the perimeter of the rubber roller 14, and extends toward the rear.

The shaft seal supporting portion 64 is disposed around the middle of the side seal supporting portion 63 in the vertical direction. The side seal supporting portion 63 is recessed toward the lower front from the rear face of the side seal supporting portion 63 and extends in the left-right direction. The shaft seal supporting portion 64 is a generally square tube, with the end at the left and right ends being opened. The shaft seal supporting portion 64 supports a shaft seal 65.

The shaft seal 65 is a generally square tube, extending in the left-right direction. The shaft seal 65 is formed of an elastic material such as sponge or the like, and has a supply roller shaft insertion hole 66 formed therein.

The supply roller shaft insertion hole 66 is situated at the generally middle portion of the shaft seal 65 in side view. The supply roller shaft insertion hole 66 has a generally circular shape in side view, and pass through the shaft seal 65 in the left-right direction. The rear face of the shaft seal 65 is generally arc-shaped in side view, so as to follow the perimeter of the rubber roller 14, and is generally flush with the rear face of the side seal supporting portion 63.

The spacer fixing portion 58 continues from the upper edges of the seal supporting units 56 and protrudes upwards. Each spacer fixing portion 58 has a base portion 70, an extending portion 71, a cylindrical portion 72, and a frame boss 73 which is an example of a second engaged portion.

The base portion 70 is disposed at the bottom portion of the spacer fixing portion 58, as illustrated in FIG. 4. The base portion 70 has a general plate shape, which bends outwards in the left and right directions after having protruded upwards continuously from the top portion of the seal supporting unit 56. The outer edge portions of the base portion 70 in the left-right direction are continuous with inner faces of later-described developing roller attaching portions 59.

The extending portion 71 is disposed at the front edge of the spacer fixing portion 58, and has a general plate form, generally rectangular in frontal view. The base portion 70 has a generally rectangular shape in plan view. The lower portion of the rear of the extending portion 71 is continuous with the front edge portion of the base portion 70, and the outer edge portions of the extending portions 71 in the left-right direction are continuous with inner face of the later-described developing roller attaching portions 59.

The cylindrical portion 72 has a generally cylindrical shape extending in the left-right direction, and is embedded in a bent portion of the base portion 70. The front edge portion of the cylindrical portion 72 is connected to the inner portions in the left-right direction of the extending portion 71 at the rear face thereof. A rear face 74 of the cylindrical portion 72 is formed following the vertical and left-right directions.

The frame boss 73 is disposed on the rear face 74 of the cylindrical portion 72. The frame boss 73 protrudes rearwards from the inner peripheral edge of the cylindrical portion 72 at the rear face 74 thereof, that is to say toward the square spacer 44 in a state where the layer thickness regulating blade 6 is assembled to the developing frame 2 by the square spacers 44. The frame boss 73 has a generally cylindrical shape, and is formed such that the outer diameter thereof is smaller than the outer diameter of the cylindrical portion 72. The inner diameter of the frame boss 73 is generally the same as the inner diameter of the cylindrical portion 72. The rear edge portion of the frame boss 73 is situated further toward the front than the rear face of the blade seal supporting portion 62, as illustrated in FIG. 3B.

Note that the cylindrical portion 72 and frame boss 73 have screw threads formed on the inner peripheral faces thereof, omitted from illustration.

The developing roller attaching portion 59 extends rearwards from the outer edge portion of the seal supporting unit 56 in the left-right direction, as illustrated in FIG. 4. The top of the developing roller attaching portion 59 protrudes upwards beyond the seal supporting unit 56. Also, the shape of the developing roller attaching portion 59 which the left side wall 50 has and the shape of the developing roller attaching portion 59 which the right side wall 50 has are different. Accordingly, description will be made hereinafter by referring to the left side developing roller attaching portion 59 as "left developing roller attaching portion 59L" and the right side developing roller attaching portion 59 as "right developing roller attaching portion 59R".

The left developing roller attaching portion 59L has a general plate shape which is generally rectangular in side view, and which extends vertically. The left developing roller attaching portion 59L has a developing roller shaft insertion hole 68 and a notched groove 77.

The developing roller shaft insertion hole 68 is disposed at the bottom portion of the left developing roller attaching portion 59L. The developing roller shaft insertion hole 68 has a generally circular shape in side view, with the rear part opened. The developing roller shaft insertion hole 68 penetrates the left developing roller attaching portion 59L in the left-right direction. The inner diameter of the developing roller shaft insertion hole 68 is greater than the diameter of the developing roller shaft 13 of the developing roller 4.

The notched groove 77 is situated at the upper right portion of the left developing roller attaching portion 59L, around the middle in the front-back direction. The notched groove 77 is recessed from the right face of the left developing roller attaching portion 59L toward the left, and has a general open-box shape with the right side and top being opened.

The right developing roller attaching portion 59R is generally rectangular in side view, and has a general plate shape which is generally crank-shaped in rear view. The right developing roller attaching portion 59R has a top portion 79, an inclined portion 80, and a bottom portion 81.

The top portion 79 forms the upper portion of the right developing roller attaching portion 59R. The top portion 79 has a general plate shape, generally rectangular in side view, and extends in the vertical direction.

The inclined portion 80 forms the generally middle portion of the right developing roller attaching portion 59R in the vertical direction. The inclined portion 80 continues from the bottom portion of the top portion 79, and extends inclining to the left from there on down.

The bottom portion 81 forms the lower portion of the right developing roller attaching portion 59R. The bottom portion 81 continues from the bottom portion of the inclined portion 80 and extends downwards. The bottom portion 81 has a developing roller shaft insertion hole 68, the same as described above, formed at the rear end portion thereof.

The developing roller attaching portions 59 rotatably support by the developing roller 4 by accepting the left and right end portions of the developing roller shaft 13 of the developing roller 4 in the left and right developing roller shaft insertion holes 68.

The lower wall 51 has a general plate shape extending in the front-back direction, as illustrated in FIG. 1, curving downwards. The left and right edge portions of the lower wall 51 continue to the bottom portion of the pair of side walls 50.

The front wall 52 continues from the front edge portion of the lower wall 51 and extends upwards. The front wall 52 has a general plate shape, generally rectangular in frontal view. The left and right edge portions of the front wall 52 continue to the front edge portion of the main unit 55 of the pair of side walls 50.

The cover frame 48 is disposed above the base frame 47 as illustrated in FIG. 4. The cover frame 48 integrally includes a cover portion 86 and a blade seal supporting portion 87.

The cover portion 86 has a general plate shape, generally rectangular in plan view. The front edge of the cover portion 86 is fused to the top portion of the front wall 52 of the base frame 47. The left and right edges of the cover portion 86 are fused to the top portions of the pair of side walls 50 of the base frame 47.

The blade seal supporting portion 87 is disposed between the rear edge portions of the pair of the side walls 50 of the base frame 47, behind the cover portion 86. The blade seal supporting portion 87 has a general plate shape, generally rectangular in plan view. The blade seal supporting portion 87 continues from the rear edge portion of the cover portion 86 and extends rearwards. The left and right edge portions of the blade seal supporting portion 87 are fused to the pair of side walls 50 of the base frame 47. The blade seal supporting portion 87 has a plurality of screw accommodating portions 88, the number of which is four here.

The four screw accommodating portions 88 are disposed in the left-right direction with intervals therebetween, at the generally middle portion of the blade seal supporting portion 87 in the front-back direction. Each screw accommodating portion 88 is recessed downwards from the upper face of the blade seal supporting portion 87, and has a generally rectangular shape in plan view, extending in the front-back direction.

(2) Layer Thickness Regulating Blade

The layer thickness regulating blade 6 has a first clamping member 91, a second clamping member 92, and a blade member 93, as illustrated in FIGS. 1 and 4.

The first clamping member 91 is disposed above the blade seal supporting portion 87 of the cover frame 48. The first clamping member 91 has a bent plate shape, slender in the left-right direction and generally L-shaped in cross-section. In further detail, the first clamping member 91 extends in the front-back direction, and bends downward at the rear edge portion thereof. The first clamping member 91 includes two clamping portion edge portions 95 and two abutting portions 97 as illustrated in FIG. 4.

Each of the two clamping portion edge portions 95 protrude upwards from the left and right end portions of the rear edge portion of the first clamping member 91. Each of the two clamping portion edge portions 95 has a general plate shape, generally rectangular in frontal view, and has a first through hole 96 which is an example of a first through-hole.

The first through holes 96 penetrate the clamping portion edge portions 95 in the front-back direction. The first through holes 96 have a generally circular shape in frontal view. The inner perimeters of the first through holes 96 define first engaging portions 98.

Each of the two abutting portions 97 is cut so that the end portions of the bottom portion of the first clamping member 91 in the left-right direction are chamfered. The abutting portions 97 incline upwards toward the outside in the left-right direction.

The second clamping member 92 is disposed above the first clamping member 91 as illustrated in FIGS. 1 and 4. The second clamping member 92 has a bent plate shape, slender in the left-right direction and generally L-shaped in cross-section. In further detail, the second clamping member 92 extends in the front-back direction above the first clamping member 91, and bends downward at the rear edge portion thereof so as to face the rear end portion of the first clamping member 91. The dimensions of the second clamping member 92 in the left-right direction are shorter than the dimensions of the first clamping member 91 in the left-right direction. The second clamping member 92 is fixed to the first clamping member 91 by screws 99.

The blade member 93 has a general plate shape, slender in the left-right direction and generally rectangular in frontal view. The blade member 93 extends in the vertical direction. The dimensions of the blade member 93 in the left-right direction are shorter than the dimensions of the first clamping member 91 in the left-right direction, and are longer than the dimensions of the second clamping member 92 in the left-right direction. The top portion of the blade member 93 is clamped between the rear end portion of the first clamping member 91 and the rear end portion of the second clamping member 92. The bottom portion of the blade member 93 is in contact with the top portion of the developing roller 4 in a state where the layer thickness regulating blade 6 has been assembled to the developing frame 2 by way of the square spacers 44, which will be described later.

(3) Blade Seal and Side Seals

The blade seal 45 is formed of an elastic material such as sponge, and has a general plate shape, generally rectangular in rear view and extending in the left-right direction, as illustrated in FIG. 4. The left and right end portions of the blade seal 45 are slightly bent downwards. The blade seal 45 comes into contact with the rear face of the blade seal supporting portion 87 of the cover frame 48 up to the rear face of the blade seal supporting portions 62 of the pair of side walls 50.

By being assembled to the developing frame 2, the blade seal 45 is supported by the blade seal supporting portion 87 by being clamped between the first clamping member 91 and blade member 93 of the layer thickness regulating blade 6, and the rear face of the blade seal supporting portion 87, which will be described in detail later.

Two side seals 46 are provided, one for each of the side seal supporting portions 63 at the left and right. The base portions of the side seals 46 are formed of an elastic member such as sponge or the like, and the surfaces are formed of a fiver material such as felt or cashmere as illustrated in FIG. 3B. Each side seal 46 is curved to form a general C-shape in side view which is opened toward the upper rear direction. Each side seal 46 is disposed between a side seal supporting portions 63 of one of the pair of side walls 50 and an end portion of the rubber roller 14 of the developing roller 4 in the left-right direction, beneath the end portions of the blade seal 45 in the left-right direction. Note that the top portions of the side seals 46 and the end portions of the blade seal 45 in the left-right direction are in contact.

(4) Square Spacers

Figure 5A:
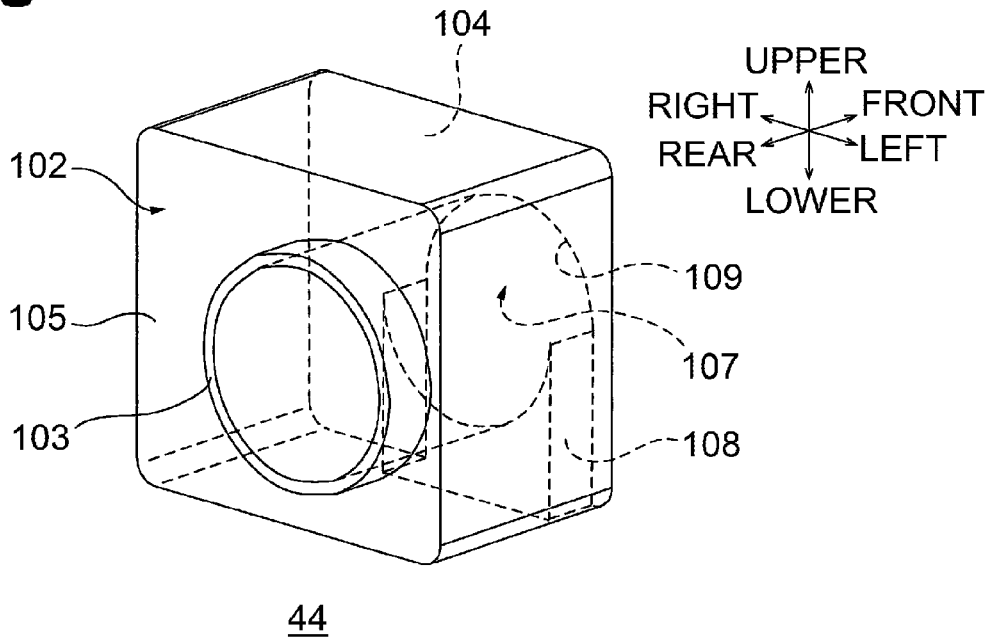
FIG. 5A is a perspective view of a square spacer illustrated in FIG. 4 as viewed from the left rear side.
Figure 5B:
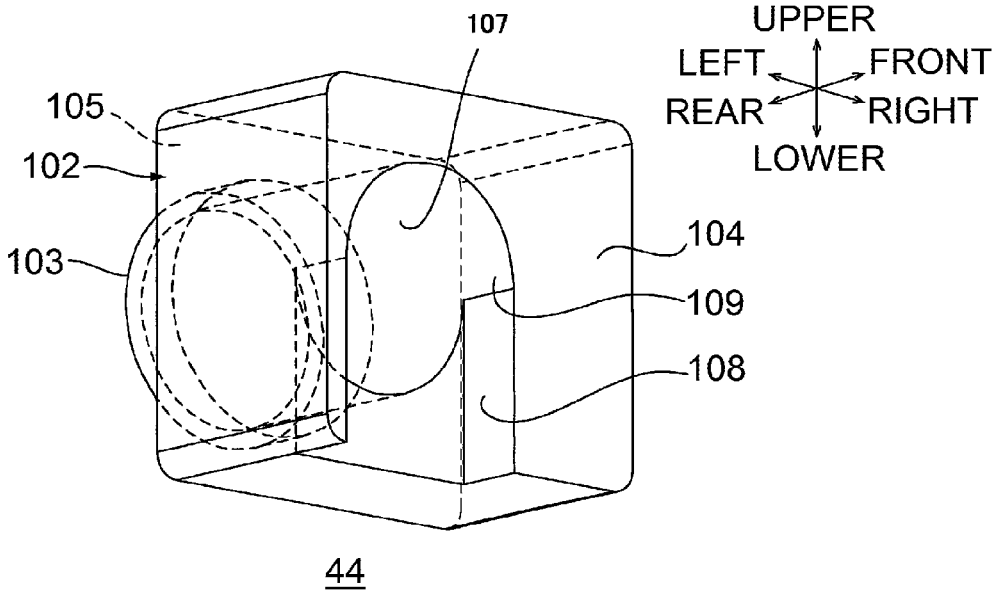
FIG. 5B is a perspective view of the square spacer illustrated in FIG. 4 as viewed from the left front side.

Two square spacers 44 are provided, corresponding to the left and right spacer fixing portions 58. Each of the square spacers 44 has a spacer main unit 102 and a spacer boss 103 which is an example of a first engaged portion, as illustrated in FIGS. 5A and 5B.

The spacer main unit 102 is generally formed as a square column, with a front face 104 and rear face 105 of the spacer main unit 102 following the vertical and left-right directions. The spacer main unit 102 has a second through hole 107 which is an example of a second through-hole, and an engaging groove 108.

The second through hole 107 penetrates the generally middle portion of the spacer main unit 102 in the front-back direction in frontal view. The second through hole 107 has a generally circular shape in frontal view. The inner diameter of the second through hole 107 is slightly larger than the outer diameter of the frame boss 73 of the developing frame 2. The inner perimeter of the second through hole 107 defines a second engaging portion 109.

The engaging groove 108 is disposed at the lower front end of the spacer main unit 102. The engaging groove 108 extends vertically as a recess toward the rear side, from the front face 104 of the spacer main unit 102, to a depth of around ⅓ the front-back direction dimensions of the spacer main unit 102. The top portion of the engaging groove 108 is opened so as to communicate with the second through hole 107. The bottom portion of the engaging groove 108 is opened downwards. The dimensions of the engaging groove 108 in the left-right direction are generally the same as the inner diameter of the second through hole 107, and slightly larger than the outer diameter of the frame boss 73. That is to say, the engaging groove 108 is a groove which has been notched out such that the frame boss 73 can pass through the square spacer 44.

The spacer boss 103 protrudes toward the rear from the rim of the second through hole 107 on the rear face 105 of the spacer main unit 102, which is to say protrudes toward the layer thickness regulating blade 6 in a state where the layer thickness regulating blade 6 has been assembled to the developing frame 2 via the square spacers 44, which will be described later. That is to say, when viewed from the rear, the second through hole 107 penetrates the square spacer 44 so as to be within the spacer boss 103. The spacer boss 103 has a generally cylindrical shape. The outer diameter of the spacer boss 103 is slightly smaller than the inner diameter of the first through hole 96 of the layer thickness regulating blade 6. The inner diameter of the spacer boss 103 is generally the same as the inner diameter of the second through hole 107. Further, the dimensions of the spacer boss 103 in the front-back direction in the front-back direction are slightly shorter than the thickness of the first clamping member 91.

4. Assembly State of the Layer Thickness Regulating Blade

The layer thickness regulating blade 6 is assembled to the developing frame 2 via two square spacers 44 by screws 111, as illustrated in FIGS. 3A and 3B.

More specifically, the layer thickness regulating blade 6 is disposed at the rear end portion of the developing frame 2 such that the front portion of the first clamping member 91 faces the blade seal supporting portion 87 upwards, and the rear portion of the first clamping member 91 faces the top portion of the blade seal supporting portion 87 toward the rear, as illustrated in FIG. 1.

The two square spacers 44 are each disposed between the corresponding clamping portion edge portion 95 of the layer thickness regulating blade 6, and the cylindrical portion 72 of the corresponding spacer fixing portion 58, as illustrated in FIGS. 3A and 3B. That is to say, the square spacers 44 are disposed to the front of the layer thickness regulating blade 6.

More specifically, the front face 104 of the spacer main unit 102 and the rear face 74 of the cylindrical portion 72 come into contact in the front-back direction, and the frame boss 73 of the spacer fixing portion 58 are inserted through the front portion of the second through hole 107 of the square spacer 44. Accordingly, the outer perimeter face of the frame boss 73 is in contact with the inner perimeter face of the second through hole 107, and engages the second engaging portion 109 in the radial direction of the frame boss 73. Accordingly, movement of the square spacer 44 in the radial direction of the frame boss 73 is restricted with regard to the developing frame 2.

Also, the rear face 105 of the spacer main unit 102 and the front face of the clamping portion edge portions 95 come into contact in the front-back direction, and the spacer boss 103 of the square spacer 44 is inserted through the first through hole 96 of the clamping portion edge portions 95. Accordingly, the outer perimeter face of the spacer boss 103 is in contact with the inner perimeter face of the first through hole 96, and engages the first engaging portions 98 in the radial direction of the spacer boss 103. Accordingly, the layer thickness regulating blade 6 is restricted from moving in the radial direction of the spacer boss 103 with regard to the square spacer 44, and movement in the radial direction of the spacer boss with regard to the developing frame 2 is restricted through the square spacer 44.

Each screw 111 which is an example of a fixing member is screwed to the spacer fixing portion 58 through the first through hole 96 of the layer thickness regulating blade 6 and the second through hole 107 of the square spacer 44. Thus, the layer thickness regulating blade 6 is fixed to the developing frame 2.

At this time, the front face of the blade seal 45 comes into contact with the rear face of the blade seal supporting portion 87 of the cover frame 48 through the rear face of the blade seal supporting portions 62 of the pair of side walls 50, and the rear face thereof comes into contact with the front face of the rear end portion of the first clamping member 91 and the front face of the blade member 93 as illustrated in FIGS. 1 and 3B. In other words, the blade seal 45 is disposed at a position between the developing frame 2 and layer thickness regulating blade 6 different from the position where the square spacers 44 are disposed.

Accordingly, the blade seal 45 is compressed in the front-back direction. Note that the rear end portion of the compressed blade seal 45 is disposed further toward the rear as compared to the rear end portion of the spacer fixing portions 58.

Also, the layer thickness regulating blade 6 is disposed further toward the front as compared to the developing roller 4. The bottom portion of the blade member 93 of the layer thickness regulating blade 6 comes into contact with the upper front portion of the rubber roller 14 of the developing roller 4.

The right abutting portion 97 of the first clamping member 91 of the layer thickness regulating blade 6 come into contact with the upper face of the inclined portion 80 of the right developing roller attaching portion 59R, as illustrated in FIG. 3A. The left end portion of the first clamping member 91 of the layer thickness regulating blade 6 is disposed within the notched groove 77 of the left developing roller attaching portion 59L. While omitted from illustration, the left abutting portion 97 of the first clamping member 91 comes into contact with the bottom portion of the notched groove 77.

Also omitted from illustration is that the bottom portions of the four screws 99 are situated within corresponding screw accommodating portions 88.

5. Mounting/Detaching Layer Thickness Regulating Blade (1) Detaching Layer Thickness Regulating Blade This layer thickness regulating blade 6 is detached from the developing frame 2 by a worker.

To detach the layer thickness regulating blade 6 from the developing frame 2, first, the two square spacers 44 are removed.

Figure 6A:
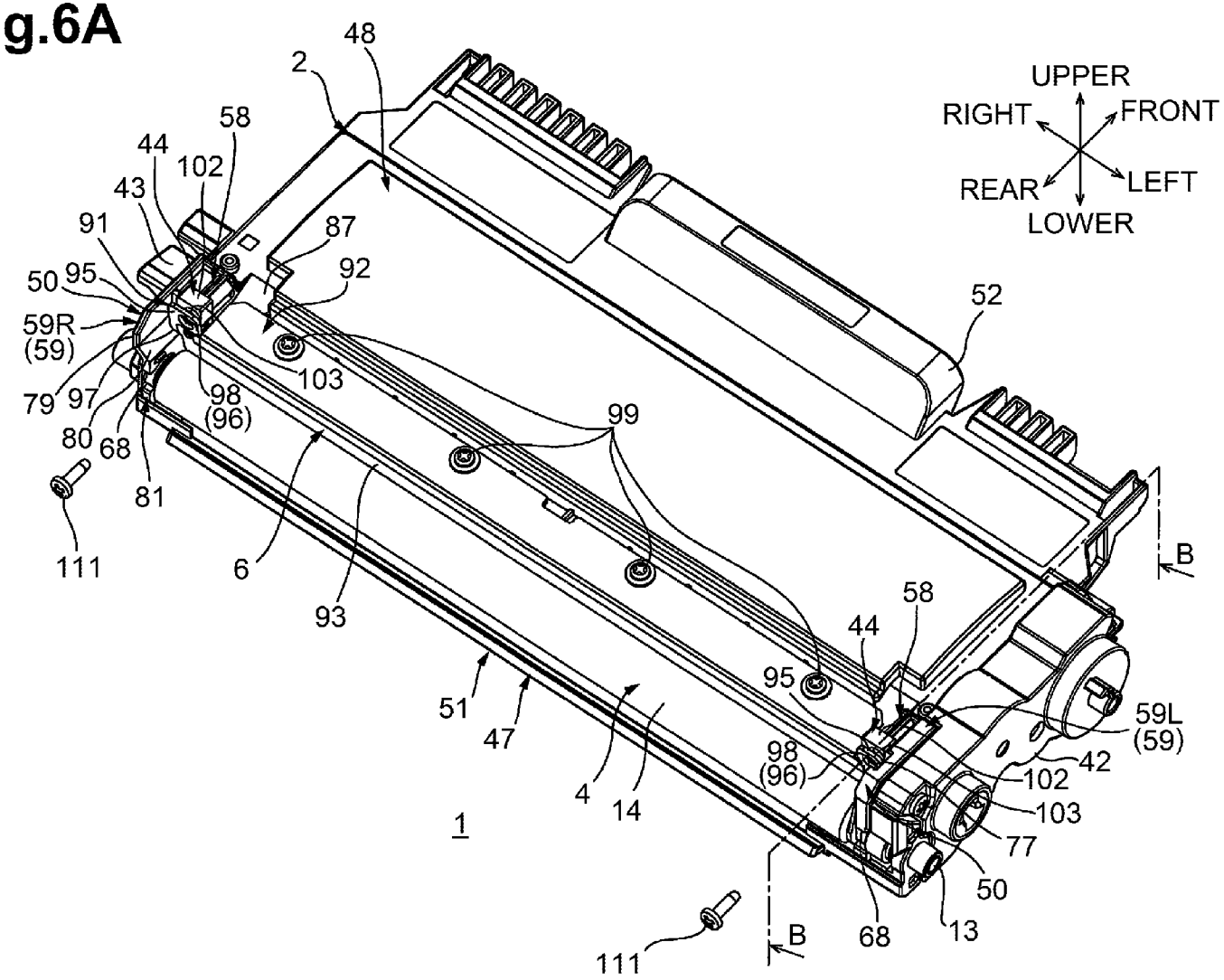
FIG. 6A is an explanatory diagram for describing attaching/detaching of the layer thickness regulating blade of the developing cartridge illustrated in FIG. 3A, illustrating a state where screws have been removed and engagement of the layer thickness regulating blade and square spacers has been disengaged.
Figure 6B:
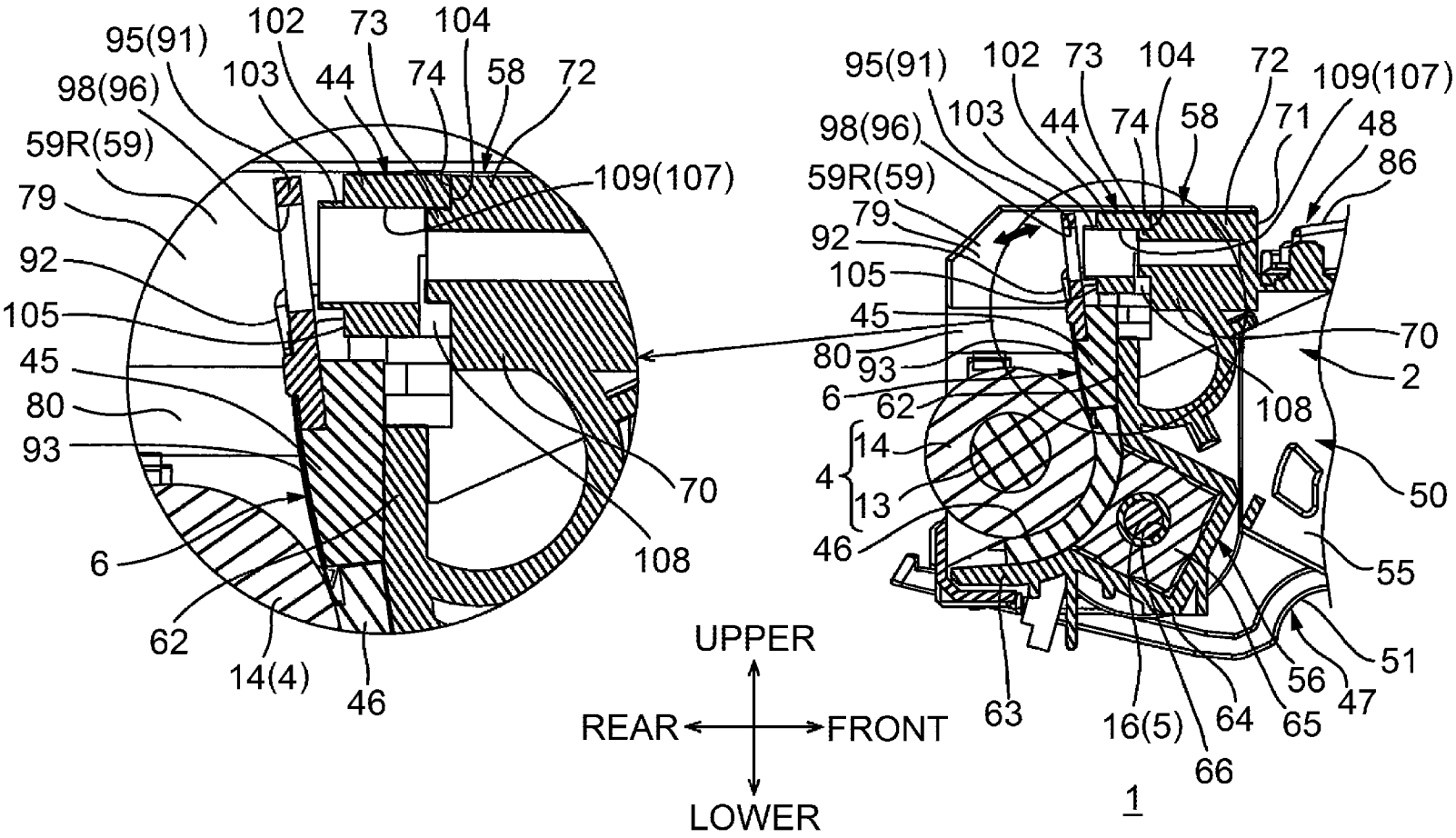
FIG. 6B is a cross-sectional view taken along line B-B in FIG. 6A.

In order to remove the two square spacers 44, two screws 111 are removed as illustrated in FIGS. 6A and 6B. This disengages the fixation of the layer thickness regulating blade 6 as to the developing frame 2.

Next, the worker turns the layer thickness regulating blade 6 counterclockwise from left side view, with the point of contact between the blade member 93 and the rubber roller 14 of the developing roller 4 as a fulcrum.

This distances the front face of the clamping portion edge portions 95 from the rear face 105 of the spacer main unit 102. The engagements between the first engaging portions 98 of the clamping portion edge portions 95 and the spacer bosses 103 of the square spacers 44 are also released.

Figure 7A:
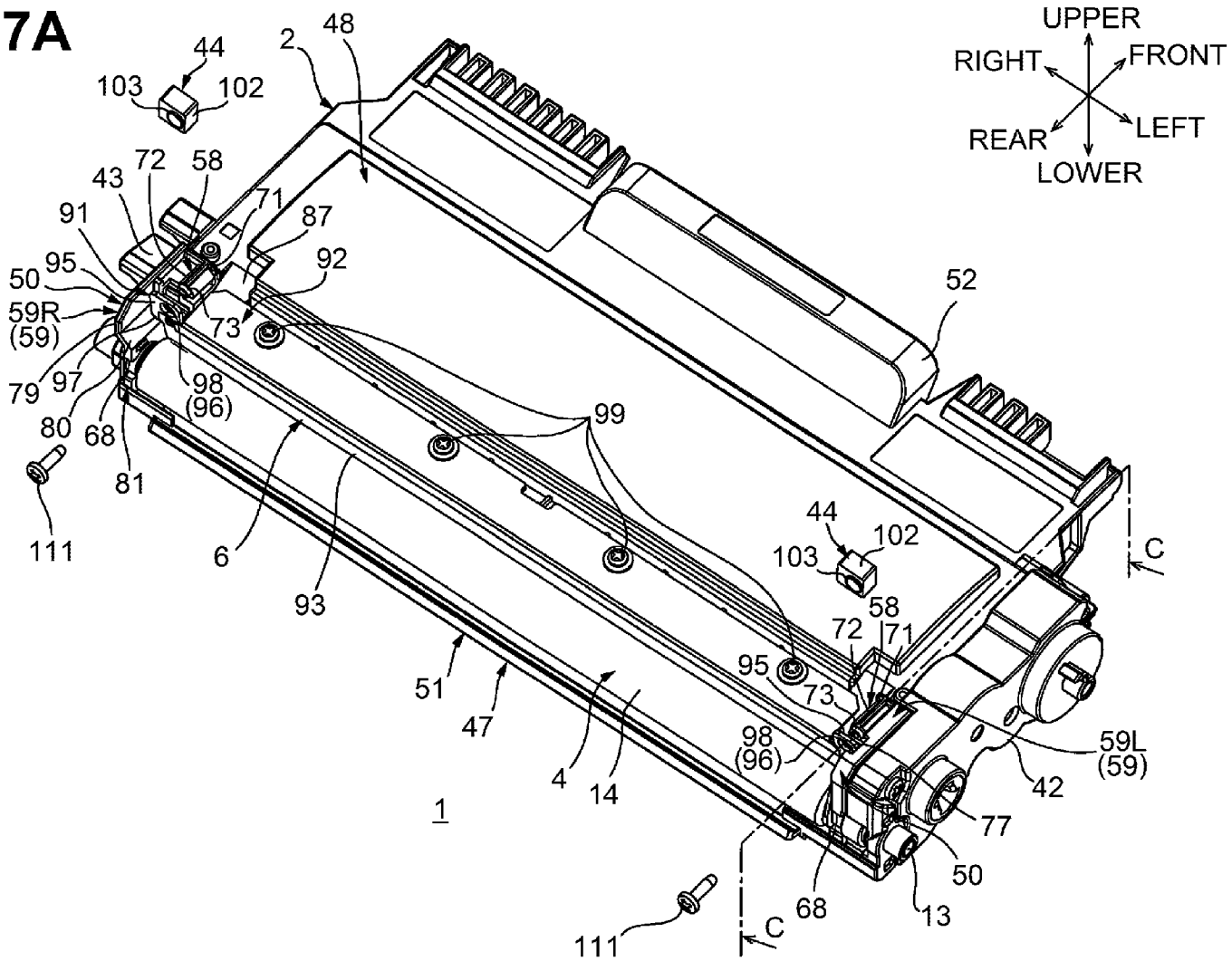
FIG. 7A is an explanatory diagram for describing attaching/detaching of the layer thickness regulating blade of the developing cartridge as a continuation from FIG. 6A, illustrating a state where the square spacers have been detached from the developing frame.
Figure 7B:
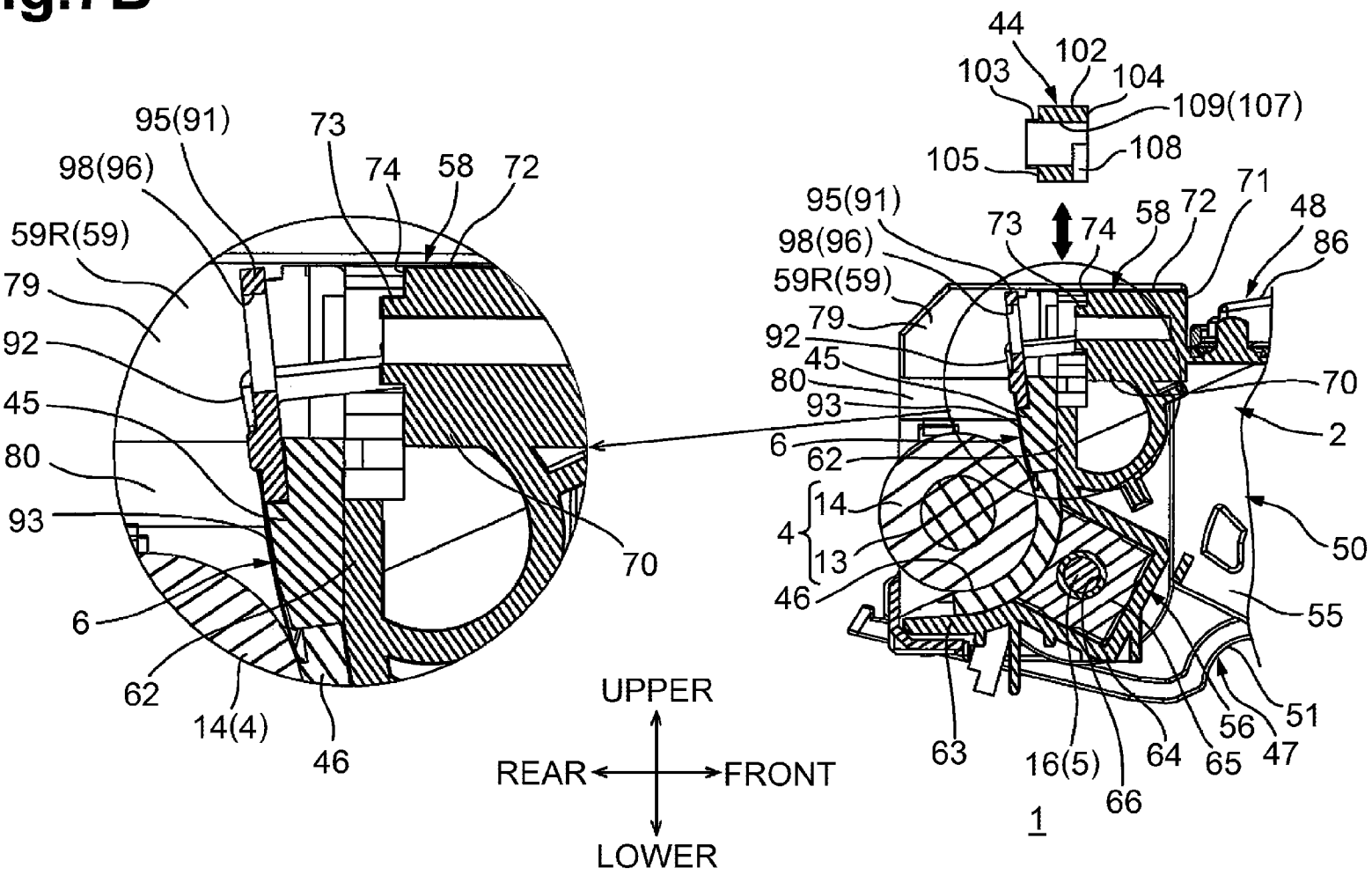
FIG. 7B is a cross-sectional view taken along line C-C in FIG. 7A.

Next, the worker moves the square spacers 44 upwards, so that the front faces 104 thereof slide over the rear faces 74 of the spacer fixing portions 58, as illustrated in FIGS. 7A and 7B. The engaging grooves 108 of the square spacers 44 permit the frame bosses 73 of the spacer fixing portions 58 to pass by at this time.

Thus, the square spacers 44 are removed from the developing frame 2.

Figure 8A:
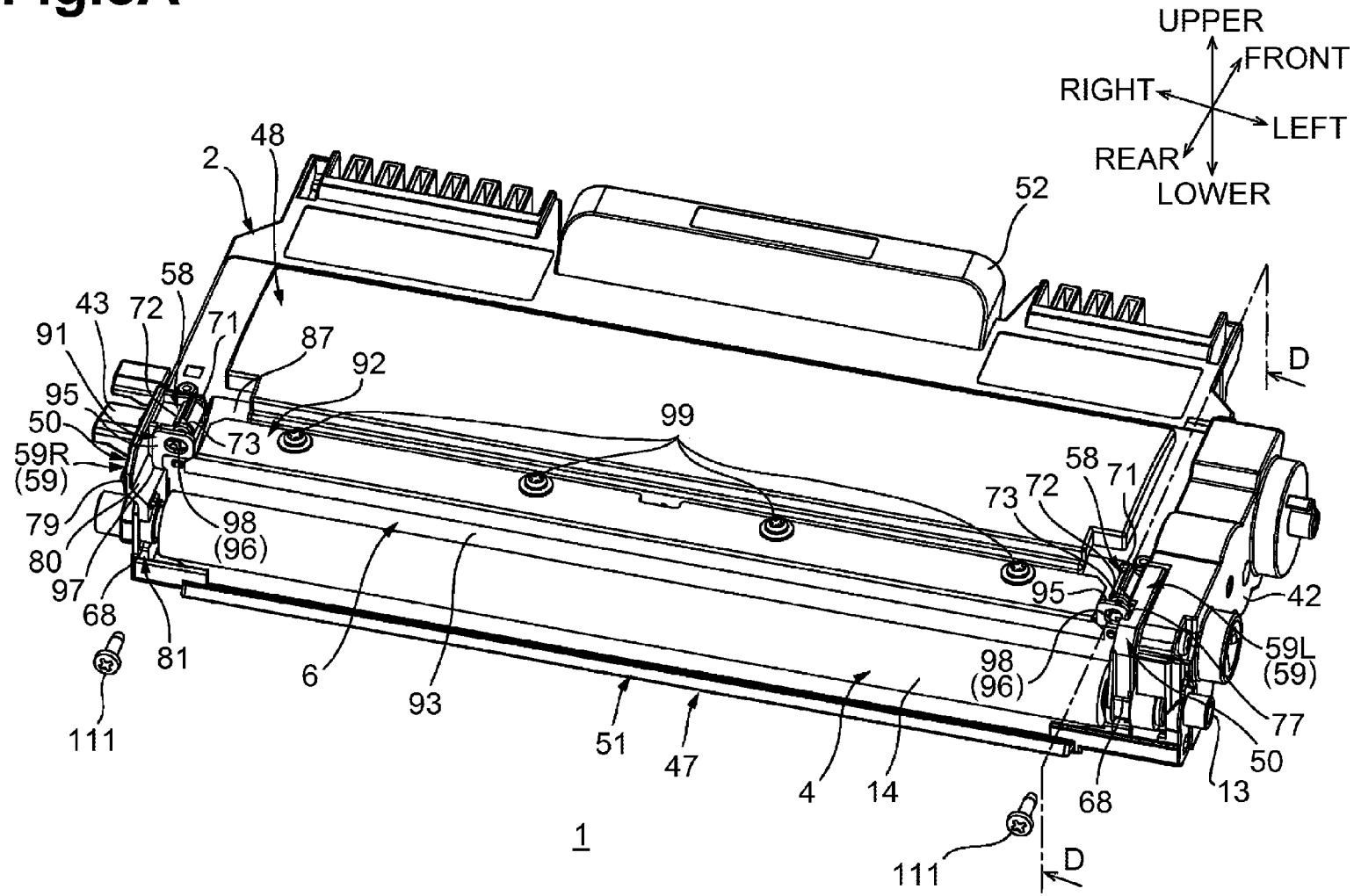
FIG. 8A is an explanatory diagram for describing attaching/detaching of the layer thickness regulating blade of the developing cartridge as a continuation from FIG. 7A, illustrating a state where the square spacers have been detached from the developing frame and the layer thickness regulating blade is compressing a blade seal.
Figure 8B:
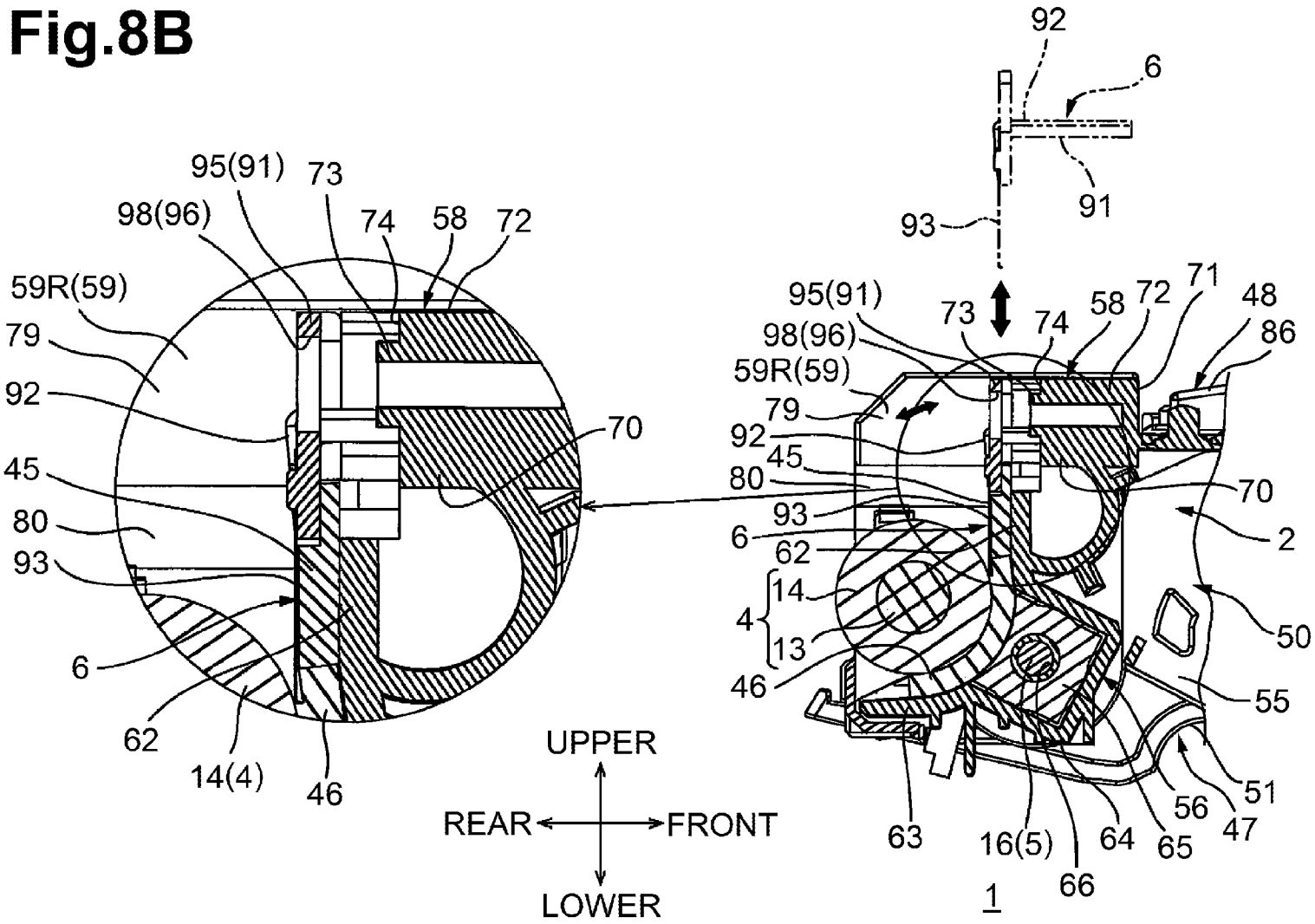
FIG. 8B is a cross-sectional view taken along line D-D in FIG. 8A.

The worker then moves the layer thickness regulating blade 6 forwards toward the blade seal supporting portion 87 as illustrated in FIGS. 8A and 8B. At this time, the layer thickness regulating blade 6 can move forwards more than when the layer thickness regulating blade 6 is assembled, since the square spacers 44 have been detached.

Thus, the layer thickness regulating blade 6 compresses the blade seal 45 in the front-back direction more than in the state where the layer thickness regulating blade 6 is assembled. The screws 99 move forward within the screw accommodating portions 88 at this time.

This reduces the contact pressure of the blade member 93 of the layer thickness regulating blade 6 against the rubber roller 14 of the developing roller 4. Alternatively, the blade member 93 of the layer thickness regulating blade 6 may be moved to where it is separated from the rubber roller 14 of the developing roller 4.

The layer thickness regulating blade 6 is then moved upwards so as to be extracted from the developing frame 2 as indicated by the imaginary line in FIG. 8B and as illustrated in FIG. 4.

This competes detaching of the layer thickness regulating blade 6 from the developing frame 2.

(2) Mounting the Layer Thickness Regulating Blade

The layer thickness regulating blade 6 is mounted to the developing frame 2 by performing the above-described procedures in reverse.

First, the worker assembles the layer thickness regulating blade 6 to the developing frame 2 while compressing the blade seal 45 against the blade seal supporting portion 62.

Specifically, the layer thickness regulating blade 6 is assembled to the developing frame 2 such that the front portion of the first clamping member 91 approaches the upper face of the blade seal supporting portion 87, in a state where the blade seal 45 is compressed against the blade seal supporting portion 62, as illustrated in FIGS. 8A and 8B.

This causes the right abutting portion 97 of the first clamping member 91 of the layer thickness regulating blade 6 to come into contact with the inclined portion 80 of the right developing roller attaching portion 59R. The left end of the first clamping member 91 of the layer thickness regulating blade 6 is situated in the notched groove 77 of the left developing roller attaching portion 59L, such that the left abutting portion 97 of the first clamping member 91 is in contact with the bottom portion of the notched groove 77, though this is not illustrated.

Also omitted from illustration is that the bottom portions of the four screws 99 of the layer thickness regulating blade 6 are situated within corresponding screw accommodating portions 88.

Accordingly, the blade member 93 faces the rear face of the blade seal supporting portion 62 and the rear face of the blade seal supporting portion 87, so as to clamp the blade seal 45.

The bottom portion of the blade member 93 comes into contact with the top portion of the rubber roller 14 of the developing roller 4.

Next, the layer thickness regulating blade 6 is turned clockwise from left side view, with the point of contact between the blade member 93 and the rubber roller 14 of the developing roller 4 as a fulcrum, so that the dimension between the rear face 74 of the cylindrical portion 72 and the front face of the clamping portion edge portion 95 is greater than the front-back dimensions of the square spacer 44, as illustrated in FIGS. 7A and 7B.

The two square spacers 44 are then inserted from above to between the corresponding clamping portion edge portions 95 of the layer thickness regulating blade 6 and the corresponding spacer fixing portions 58 as illustrated in FIGS. 6A and 6B. Specifically, the square spacers 44 are moved downwards, so that the front faces 104 of the spacer main units 102 slide over the rear faces 74 of the spacer fixing portions 58, and thus attached to the developing frame 2.

At this time, the frame bosses 73 of the spacer fixing portions 58 pass through the engaging grooves 108 of the square spacer 44 and come into contact with the front end portion of the inner peripheral face of the second through holes 107. Thus, the frame bosses 73 of the spacer fixing portions 58 are engaged with the second engaging portions 109 of the square spacers 44.

Next, the layer thickness regulating blade 6 is turned clockwise from left side view, with the point of contact between the blade member 93 and the rubber roller 14 of the developing roller 4 as a fulcrum as illustrated in FIGS. 6A and 6B.

This results in the first through holes 96 of the layer thickness regulating blade 6 accepting the spacer bosses 103 of the square spacers 44, and the front faces of the clamping portion edge portions 95 coming into contact with the rear faces 105 of the spacer main units 102. Accordingly, the spacer bosses 103 of the square spacers 44 engage the first engaging portions 98 of the layer thickness regulating blade 6.

The screws 111 are then screwed to the spacer fixing portions 58 through the first through holes 96 of the layer thickness regulating blade 6 and the second through holes 107 of the square spacers 44, thus fixing the layer thickness regulating blade 6 to the developing frame 2.

This completes mounting of the layer thickness regulating blade 6 to the developing frame 2.

6. Advantages (1) As illustrated in FIG. 3B, the layer thickness regulating blade 6 of the developing cartridge 1 is assembled to the developing frame 2 via the square spacers 44, by the spacer bosses 103 protruding toward the layer thickness regulating blade 6 engaging the first engaging portions 98 in the radial direction of the spacer bosses 103.

Engagement of the layer thickness regulating blade 6 as to the spacer bosses 103 is released by detaching the square spacers 44 from the developing frame 2, as illustrated in FIG. 7B.

Accordingly, the layer thickness regulating blade 6 alone can be easily replaced, without having to remove the developing roller 4 from the developing cartridge 1 in order to release the engagement between the first engaging portions 98 and spacer bosses 103, as illustrated in FIG. 8B.

(2) Also, the first engaging portions 98 are the inner peripheral faces of the first through holes 96 penetrating the clamping portion edge portions 95 of the blade member 93 of the layer thickness regulating blade 6 in the front-back direction, so the spacer bosses 103 are engaged by being inserted into the first through holes 96, as illustrated in FIGS. 6A and 6B.

Accordingly, the layer thickness regulating blade 6 and square spacers 44 can be engaged with a simple configuration, as illustrated in FIGS. 3A and 3B.

(3) The layer thickness regulating blade 6 is fixed to the developing frame 2 in the front-back direction by the screws 111, through the first through holes 96 of the layer thickness regulating blade 6 and the second through holes 107 of the square spacers 44 as illustrated in FIGS. 3A and 3B.

Accordingly, the relative movement of the layer thickness regulating blade 6 as to the developing frame 2 in the radial direction of the spacer bosses 103 is restricted by the engaging of the first engaging portions 98 and the spacer bosses 103 of the square spacers 44, and relative movement in the front-back direction is restricted by the screws 111.

Accordingly, the layer thickness regulating blade 6 can be securely fixed to the developing frame 2.

(4) Also, the square spacers 44 are assembled to the developing frame 2 by the frame bosses 73 protruding toward the square spacer 44 engaging the second engaging portions 109 in the radial direction of the frame bosses 73, as illustrated in FIG. 3B.

Accordingly, the developing frame 2 is engaged with the square spacers 44, and the square spacers 44 are engaged with the layer thickness regulating blade 6, so the developing frame 2 supports the layer thickness regulating blade 6 via the square spacers 44.

(5) The square spacers 44 are mounted to and detached from the developing frame 2 by the frame bosses 73 of the developing frame 2 moving so as to pass through the engaging grooves 108, as illustrated in FIGS. 5B and 7B.

Accordingly, the square spacers 44 along can be easily mounted/detached while the layer thickness regulating blade 6 and developing roller 4 remain assembled to the developing frame 2.

(6) The blade seal 45 is disposed at a position between the developing frame 2 and the layer thickness regulating blade 6, which is different from the position where the square spacers 44 are disposed, as illustrated in FIGS. 3B and 4.

Accordingly, toner leakage from the developing frame 2 can be suppressed, even though square spacers 44 to facilitate mounting/detaching of the layer thickness regulating blade 6 are disposed between the developing frame 2 and layer thickness regulating blade 6.

(7) Also, the rear end portion of the blade seal 45 is disposed behind the rear end portions of the spacer fixing portions 58, i.e., toward the layer thickness regulating blade 6 side, as illustrated in FIG. 8B. Thus, when removing the layer thickness regulating blade 6 in a state where the square spacers 44 have been detached from the developing frame 2, the layer thickness regulating blade 6 can be moved forward and the blade seal 45 pressed against the developing frame 2 side.

Accordingly, this moving the layer thickness regulating blade 6 forward so as to compress the blade seal 45 in the front-back direction enables contact pressure of the layer thickness regulating blade 6 against the developing roller 4 to be reduced, so the layer thickness regulating blade 6 can be detached more easily.

7. Second Embodiment

A second embodiment of the cartridge according to the present invention will be described with reference to FIGS.

9A through 13B. Components in the second embodiment which are the same as those in the above-described first embodiment are denoted with the same reference numerals, and description thereof will be omitted.

(1) Details of Developing Cartridge According to Second Embodiment

Figure 9A:
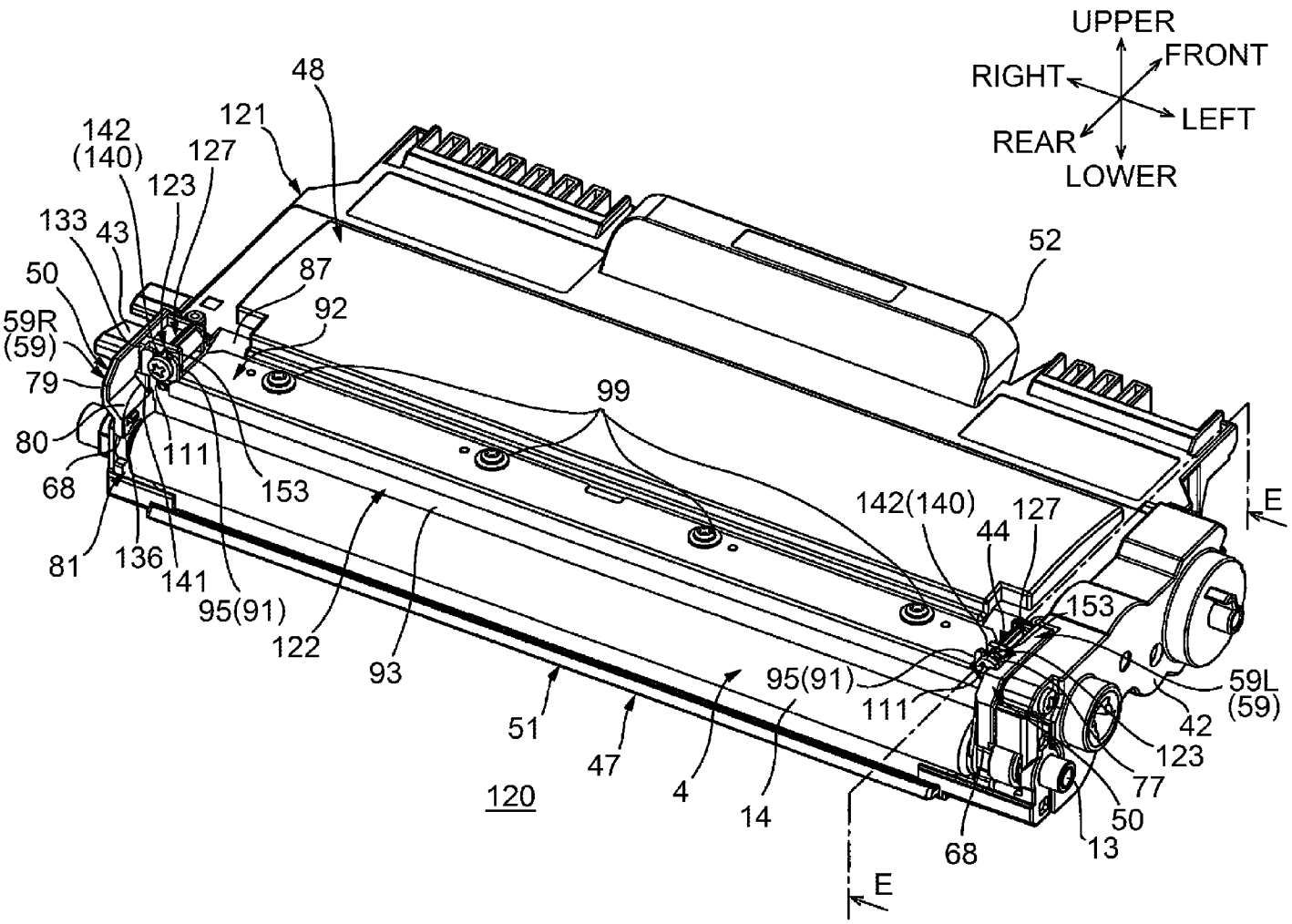
FIG. 9A is a perspective view of a developing cartridge according to a second embodiment of the present invention as viewed from the left rear side.
Figure 9B:
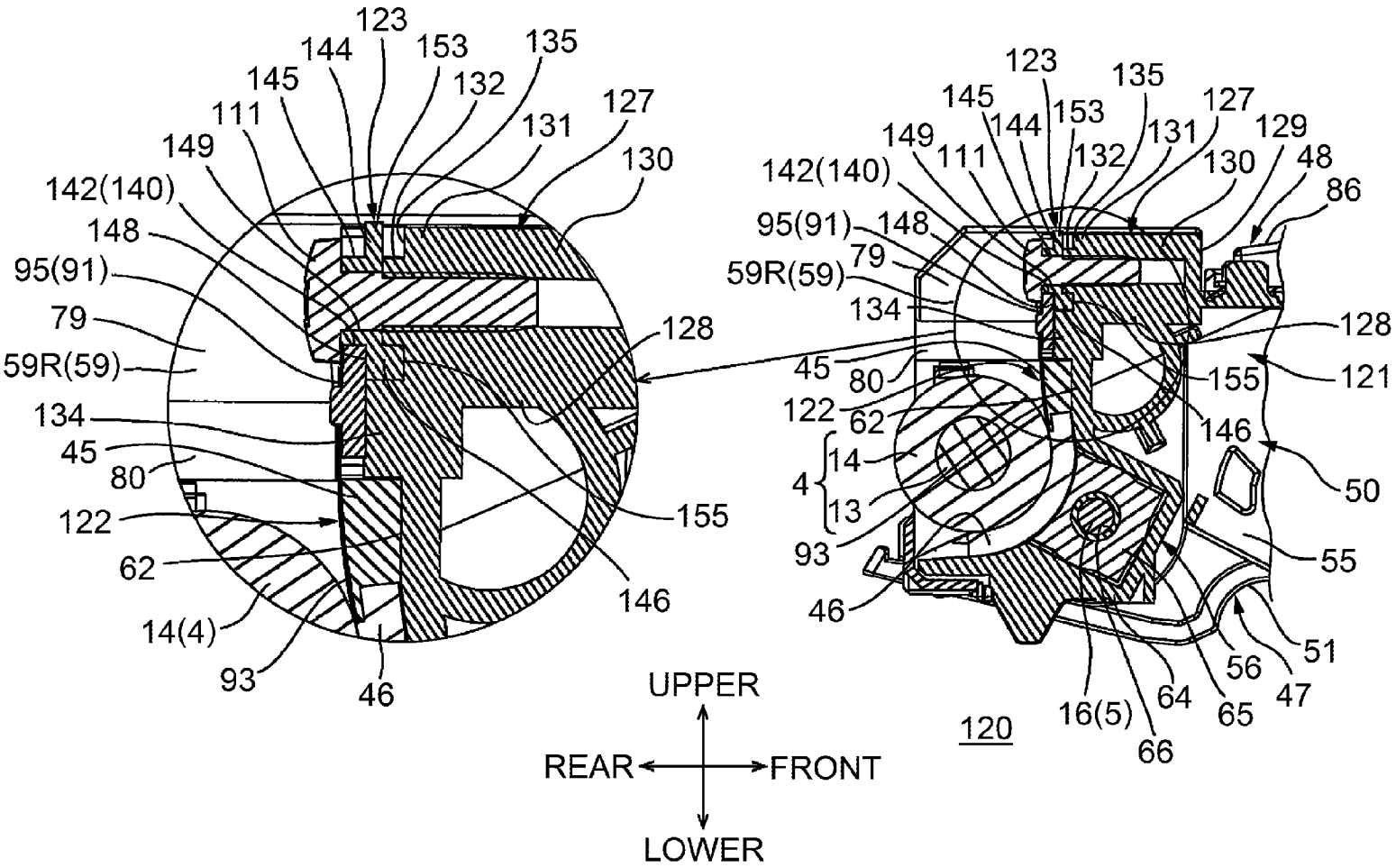
FIG. 9B is a cross-sectional view taken along line E-E in FIG. 9A.

A developing cartridge 120 which is an example of a cartridge includes a developing frame 121 which is an example of a housing, a layer thickness regulating blade 122 which is an example of a layer thickness restricting member, and a rotational spacer 123 which is an example of a spacer, as illustrated in FIGS. 9A and 9B.

(1-1) Details of Developing Frame According to Second Embodiment

The developing frame 121 has a base frame 47 and a cover frame 48. Each of the pair of side walls 50 of the base frame 47 has a spacer fixing portion 127 which is an example of a fixing portion, as illustrated in FIG. 10.

Figure 10:
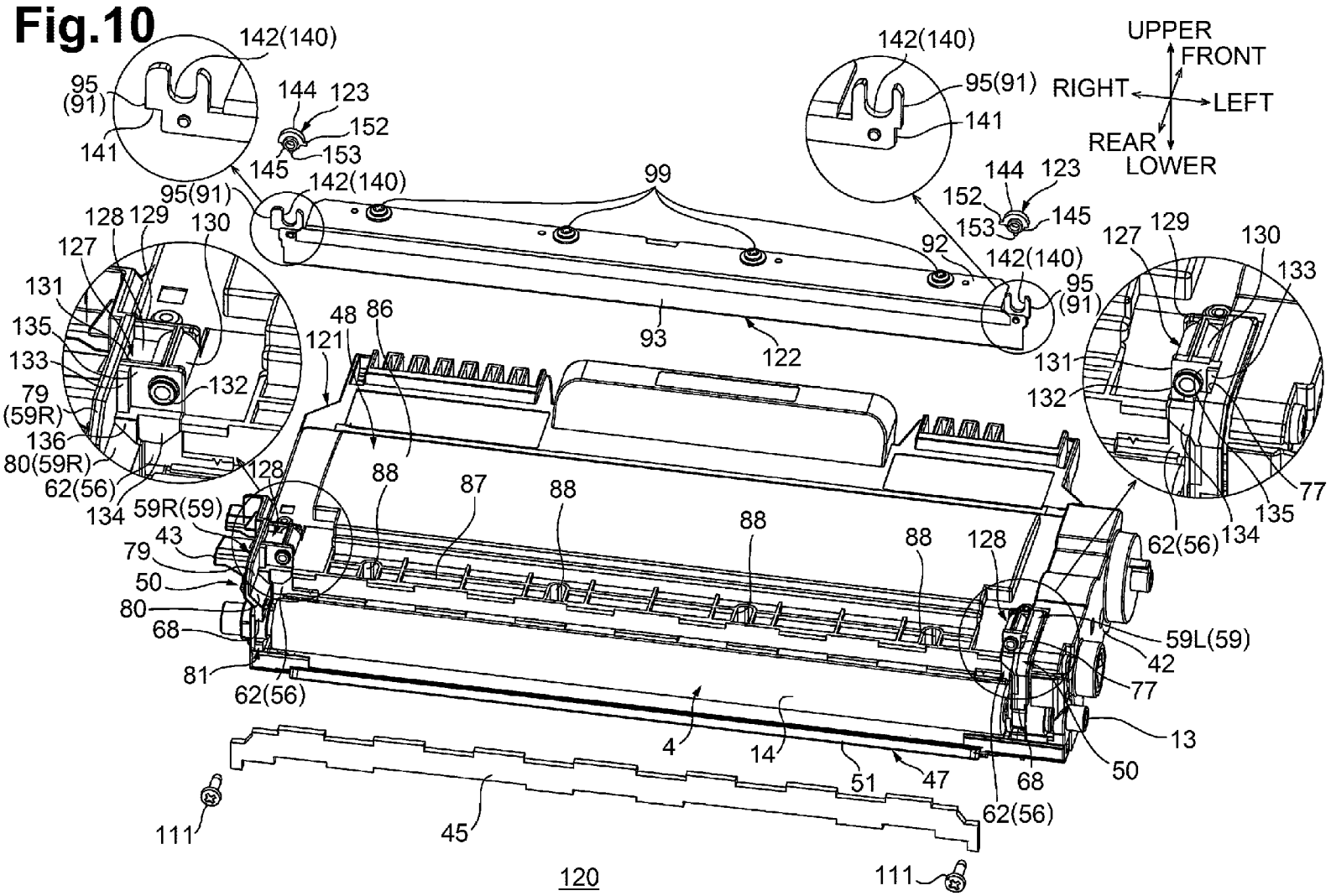
FIG. 10 is a disassembled perspective view of the developing cartridge illustrated in FIG. 9A as viewed from the left rear side.

As illustrated in FIGS. 9B and 10, each spacer fixing portion 127 continues form and protrudes upwards from the upper end of the seal supporting member 56. Each spacer fixing portion 127 has a base portion 128 a first extending portion 129, a cylindrical portion 130, a second extending portion 131, a frame boss 132 which is an example of a second engaged portion, a pillar portion 133, and a bulging portion 134.

The base portion 128 is disposed at the bottom portion of the spacer fixing portion 127. The base portion 128 has a general plate shape, generally rectangular in plan view, which protrudes upwards continuously from the top portion of the seal supporting unit 56. The outer edge portions of the base portion 70 in the left-right direction are continuous with inner faces of the developing roller attaching portions 59.

The first extending portion 129 is disposed at the front edge of the spacer fixing portion 127, and has a plate form, generally rectangular in frontal view. The lower portion of the rear of the spacer fixing portion 127 is continuous with the front edge portion of the base portion 128, and the outer edge portions of the first extending portions 129 in the left-right direction are continuous with inner faces of the developing roller attaching portions 59.

The cylindrical portion 130 has a generally cylindrical shape extending in the front-back direction. The cylindrical portion 130 is embedded in the inward portion of the base portion 128 in the left-right direction. The front edge portion of the cylindrical portion 130 is connected to the inward portion in the left-right direction of the first extending portion 129 at the rear face of the first extending portion 129. The rear edge portion of the cylindrical portion 130 is connected to the inward portion in the left-right direction of the second extending portion 131.

The second extending portion 131 is adjacent behind the rear edge portion of the cylindrical portion 130. The shape of the second extending portion 131 is the same as that of the first extending portion 129. When projected in the front-back direction, the shapes of the second extending portion 131 and the first extending portion 129 are the same and overlaid. The bottom portion of the second extending portion 131 is continuous from the rear edge portion of the base portion 128.

A rear face 135 of the second extending portion 131 extends in the vertical and left-right directions. The rear face 135 of the second extending portion 131 is situated at generally the same position of the rear portion of the blade seal supporting portion 62 of the seal supporting unit 56 in the front-back direction.

The second extending portion 131 has a through hole which, when projected in the front-back direction, overlays the inner perimeter of the cylindrical portion 130, and has the same dimensions as the inner diameter of the cylindrical portion 130.

The frame boss 132 protrudes rearwards from the inner peripheral edge of the through hole at the rear face 135 of the second extending portion 131, that is to say toward the rotational spacer 123 in a state where the layer thickness regulating blade 122 is assembled to the developing frame 121 by the rotational spacers 123. The frame boss 132 has a generally cylindrical shape, and is formed such that the outer diameter thereof is smaller than the outer diameter of the cylindrical portion 130. The inner diameter of the frame boss 132 is generally the same as the inner diameter of the cylindrical portion 130, and also the inner diameter of the through hole of the second extending portion 131. The rear edge portion of the frame boss 132 is situated further toward the back than the rear face of the blade seal supporting portion 62 of the second phase-change unit 56, as illustrated in FIG. 9B.

Note that the cylindrical portion 130, through hole of the second extending portion 131, and frame boss 132 have screw threads formed on the inner peripheral faces thereof, omitted from illustration.

Each pillar portion 133 is disposed behind the outward edge portion of the second extending portion 131 in the left-right direction, as illustrated in FIG. 10. The pillar portion 133 protrudes backwards from the rear face of the second extending portion 131, and has a generally square pillar form extending in the vertical direction. The other edge portions of the pillar portions 133 in the left-right direction are connected to the left and right inner faces of the developing roller attaching portions 59.

The bulging portion 134 is disposed beneath the second extending portion 131. The bulging portion 134 protrudes backwards farther than the second extending portion 131, and has a generally rectangular shape in rear view. The rear edge portion of the bulging portion 134 is situated at generally the same position as the rear edge portion of the pillar portion 133 in the front-back direction. The bottom portion of the bulging portion 134 is continuous with the tip portion of the blade seal supporting portion 62, as illustrated in FIG. 9B.

The right spacer fixing portion 127 has a positioning portion 136 as illustrated in FIG. 10.

The positioning portion 136 continues from the right edge portion of the bulging portion 134 and protrudes backwards. The bottom portion of the positioning portion 136 is continuous with the upper face of the inclined portion 80 of the right developing roller attaching portion 59R. The right edge portion of the positioning portion 136 is continuous with the right face of the top portion 79 of the right developing roller attaching portion 59R. The upper face of the positioning portion 136 extends in the front-back and left-right directions. The left face of the positioning portion 136 extends in the vertical and front-back directions.

(1-2) Details of Layer Thickness Regulating Blade According to Second Embodiment The clamping portion edge portions 95 of the first clamping member 91 of the layer thickness regulating blade 122 each have a receiving groove 140 which is an example of a first through-hole, as illustrated in FIG. 10. The first clamping member 91 of the layer thickness regulating blade 122 also has two abutting portions 141.

Each receiving groove 140 has a generally U-shaped form opened upwards, recessed downwards from the upper edge of the clamping portion edge portion 95. The dimensions of the receiving groove 140 in the left-right direction are slightly larger than the outer diameter of a spacer boss 145 of the rotational spacer 123, which will be described later. That is to say, the receiving grooves 140 are grooves which have been notched out in the layer thickness regulating blade 122 so as to allow passage of the spacer bosses 145. The inner perimeter face of the receiving groove 140 defines a first engaging portion 142.

The two abutting portions 141 have each been formed by notching out the respective outer edge portions of the bottom of the first clamping member 91 in generally rectangular shapes in frontal view. The distance between the inner edge portions of the two abutting portions 141 in the left-right direction is generally the same as the length of the blade member 93 in the left-right direction.

(1-3) Details of Rotational Spacer According to Second Embodiment

Two rotational spacers 123 are provided, corresponding to the two spacer fixing portions 127. The two rotational spacers 123 are each detachably mounted to the developing frame 121. Note that in the following description, reference to directions regarding the rotational spacers 123 will be made based on the directions of the rotational spacers 123 as illustrated in FIG. 10. The two rotational spacers 123 are symmetrical in form. Accordingly, description will be made in detail regarding the right rotational spacer 123, and description of the left rotational spacer 123 will be omitted.

Figure 11A:
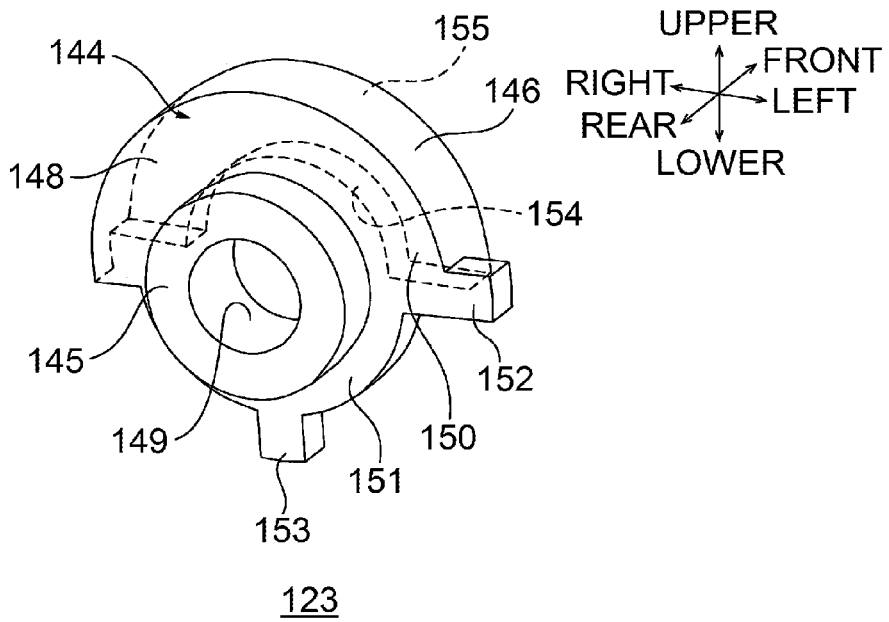
FIG. 11A is a perspective view of a rotational spacer illustrated in FIG. 10 as viewed from the left rear side.
Figure 11B:
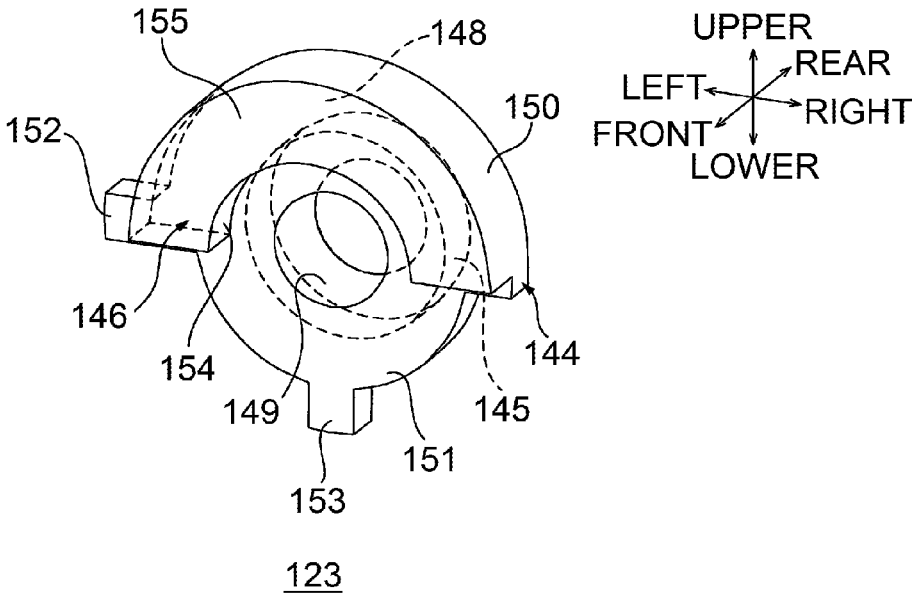
FIG. 11B is a perspective view of the rotational spacer illustrated in FIG. 10 as viewed from the left front side.

The rotational spacer 123 integrally includes a spacer disc portion 144, the spacer boss 145 which is an example of a first engaged portion, and a spacer half-ring portion 146 as illustrated in FIGS. 11A and 11B.

The spacer disc portion 144 has a general disc shape extending in the vertical and left-and-right directions. A rear face 148 of the spacer disc portion 144 extends in the vertical and left-and-right directions. The spacer disc portion 144 includes a large-diameter portion 150, a small-diameter portion 151, and a spacer hole 149 which is an example of a second through-hole.

The large-diameter portion 150 makes up the upper half of the spacer disc portion 144. The large-diameter portion 150 has a half-circle shape in rear view, which bulges upwards. The large-diameter portion 150 also includes a first knob portion 152 which is an example of a knob portion.

The first knob portion 152 protrudes to the left from the left edge portion of the large-diameter portion 150, which is to say outwards in the radial direction of the large-diameter portion 150. The first knob portion 152 has a generally rectangular shape in rear view.

The small-diameter portion 151 makes up the lower half of the spacer disc portion 144. The small-diameter portion 151 continues from the lower face of the large-diameter portion 150 and protrudes downwards. The small-diameter portion 151 has a half-circle shape in rear view, and shares the same center axial line with the large-diameter portion 150, but is smaller in outer diameter as compared to the large-diameter portion 150. The small-diameter portion 151 also includes a second knob portion 153 which is an example of a knob portion.

The second knob portion 153 protrudes downwards from the bottom portion of the small-diameter portion 151, i.e., outwards in the radial direction of the small-diameter portion. The second knob portion 153 has a generally rectangular shape in rear view.

The spacer hole 149 penetrates the spacer disc portion 144 in the front-back direction, along the center axial line of the large-diameter portion 150 and small-diameter portion 151. The spacer hole 149 has a generally circular shape in rear view. The inner diameter of the spacer hole 149 is slightly larger than the inner diameter of the frame boss 132.

The spacer boss 145 protrudes rearwards from the inner peripheral edge of the spacer hole 149 at the rear face 148 of the spacer disc portion 144, that is to say toward the layer thickness regulating blade 122 in a state where the layer thickness regulating blade 122 is assembled to the developing frame 121 by the rotational spacer 123. That is to say, when viewed from the rear, the spacer hole 149 penetrates the rotational spacer 123 so as to be within the spacer boss 145. The spacer boss 145 has a generally cylindrical shape, and is formed such that the outer diameter thereof is smaller than the left-right direction dimensions of the receiving groove 140 of the layer thickness regulating blade 122. The inner diameter of the spacer boss 145 is generally the same as the inner diameter of the spacer hole 149. The dimensions of the spacer boss 145 in the front-back direction are slightly shorter than the thickness of the first clamping member 91.

The spacer half-ring portion 146 protrudes forwards from the front face of the large-diameter portion 150 of the spacer disc portion 144. The spacer half-ring portion 146 has a general half-ring shape with the lower side opened, and shares the center axial line with the large-diameter portion 150 and the small-diameter portion 151. The outer diameter of the spacer half-ring portion 146 is generally the same as the outer diameter of the large-diameter portion 150 of the spacer disc portion 144. That is to say, the outer perimeter face of the spacer half-ring portion 146 is flush with the outer perimeter face of the large-diameter portion 150. The inner diameter of the spacer half-ring portion 146 is slightly larger than the outer diameter of the frame boss 132 of the spacer fixing portion 127. Note that the inner perimeter face of the spacer half-ring portion 146 defines a second engaging portion 154. The front face 155 of the spacer half-ring portion 146 extends in the vertical and left-right directions.

(2) Assembly State of Layer Thickness Regulating Blade

The layer thickness regulating blade 122 is assembled to the developing frame 121 via two rotational spacers 123 by screws 111, as illustrated in FIGS. 9A and 9B.

Specifically, the layer thickness regulating blade 122 is disposed at the rear end portion of the developing frame 121 such that the front portion of the first clamping member 91 faces the blade seal supporting portion 87 upwards, and the rear portion of the first clamping member 91 faces the top portion of the blade seal supporting portion 87 toward the rear, in the same way as with the first embodiment.

The front face of the layer thickness regulating blade 122 at the outer edge portions of the clamping portion edge portions 95 in the left-right direction is in contact with the front faces of the pillar portions 133 of the spacer fixing portions 127.

The front face of the layer thickness regulating blade 122 at the outer edge portions of the first clamping member 91 in the left-right direction is also in contact with the front faces of the bulging portions 134 of the spacer fixing portions 127.

The two rotational spacers 123 are each disposed between the corresponding clamping portion edge portion 95 of the layer thickness regulating blade 122, and the second extending portion 131 of the corresponding spacer fixing portion 127. The second knob portions 153 of the rotational spacer 123 are facing upwards.

More specifically, at each of the left and right sides, the front face 155 of the spacer half-ring portion 146 and rear face 135 of the second extending portion 131 come into contact in the front-back direction, and the frame boss 132 of the spacer fixing portion 127 comes into contact with the inner peripheral face of the spacer half-ring portion 146 of the rotational spacer 123 from above. That is to say, the outer peripheral face of the frame boss 132 is in contact with the inner peripheral face of the spacer half-ring portion 146, and engages the second engaging portion 154 in the radial direction of the frame boss 132. Accordingly, movement of the rotational spacer 123 in the radial direction of the frame boss 132 is restricted respective to the developing frame 121. The position of the rotational spacer 123 at this time is defined as a detaching restriction position where detachment from between the developing frame 121 and layer thickness regulating blade 122 is restricted.

The rear face 148 of the spacer disc portion 144 and the front face of the clamping portion edge portion 95 are in contact in the front-back direction, and the spacer boss 145 of the rotational spacer 123 is accepted within the receiving groove 140 of the clamping portion edge portion 95. That is to say, the outer peripheral face of the spacer boss 145 is in contact with the inner peripheral face of the receiving groove 140, and engages the first engaging portion 142 in the radial direction of the spacer boss 145. Accordingly, movement of the layer thickness regulating blade 122 in the radial direction of the spacer boss 145 is restricted respective to the rotational spacer 123, and movement of the layer thickness regulating blade 122 in the radial direction of the spacer boss 145 is restricted respective to the developing frame 121 by way of the rotational spacer 123 situated at the detaching restriction position.

The screws 111 are screwed to the spacer fixing portion 127, through the receiving grooves 140 of the layer thickness regulating blade 122, and spacer holes 149 of the rotational spacers 123.

At this time, the front face of the blade seal 45 comes into contact with the rear face of the blade seal supporting portion 87 of the cover frame 48 through the rear face of the blade seal supporting portions 62 of the pair of side walls 50, and the rear face thereof comes into contact with the front face of the rear end portion of the first clamping member 91 and the front face of the blade member 93, in the same way as with the first embodiment. In other words, the blade seal 45 is disposed at a position between the developing frame 121 and layer thickness regulating blade 122 different from the position where the rotational spacers 123 are disposed.

Accordingly, the blade seal 45 is compressed in the front-back direction. Note that the rear end portion of the compressed blade seal 45 is disposed further toward the rear as compared to the rear end portion of the spacer fixing portions 127.

The bottom portion of the blade member 93 of the layer thickness regulating blade 122 comes into contact with the upper front portion of the rubber roller 14 of the developing roller 4.

The right abutting portion 141 of the first clamping member 91 of the layer thickness regulating blade 122 come into contact with the upper face and left face of the positioning portion 136 of the right spacer fixing portion 127, as illustrated in FIG. 9A. The left end portion of the first clamping member 91 of the layer thickness regulating blade 122 is disposed within the notched groove 77 of the left developing roller attaching portion 59L. While omitted from illustration, the left abutting portion 141 of the first clamping member 91 comes into contact with the bottom portion of the notched groove 77.

Also omitted from illustration is that the bottom portions of the four screws 99 are situated within corresponding screw accommodating portions 88, in the same way as with the first embodiment.

(3) Mounting/Detaching Layer Thickness Regulating Blade According to Second Embodiment (3-1) Detaching Layer Thickness Regulating Blade According to Second Embodiment This layer thickness regulating blade 122 is detached from the developing frame 121 by a worker.

To detach the layer thickness regulating blade 122 from the developing frame 121, first, the two rotational spacers 123 are removed.

In order to remove the two rotational spacers 123, the two screws 111 are removed. This disengages the fixation of the layer thickness regulating blade 122 as to the developing frame 121.

The operations of the right rotational spacer 123 will be described in the following description. The left rotational spacer 123 is removed by operations horizontally symmetrical to the right rotational spacer 123 so description thereof will be omitted.

The worker next holds the second knob portion 153 positioned above the rotational spacer 123 situated at the detaching restriction position, and rotates the right rotational spacer 123 in the clockwise direction in rear view. The position of the second knob portion 153 thus moves from above the rotational spacer 123 to the left of the rotational spacer 123, and the position of the first knob portion 152 moves from the right of the rotational spacer 123 to above the rotational spacer 123.

The worker then releases the second knob portion 153 and holds the first knob portion 152, and further rotates the rotational spacer 123 in the clockwise direction in rear view.

Figure 12A:
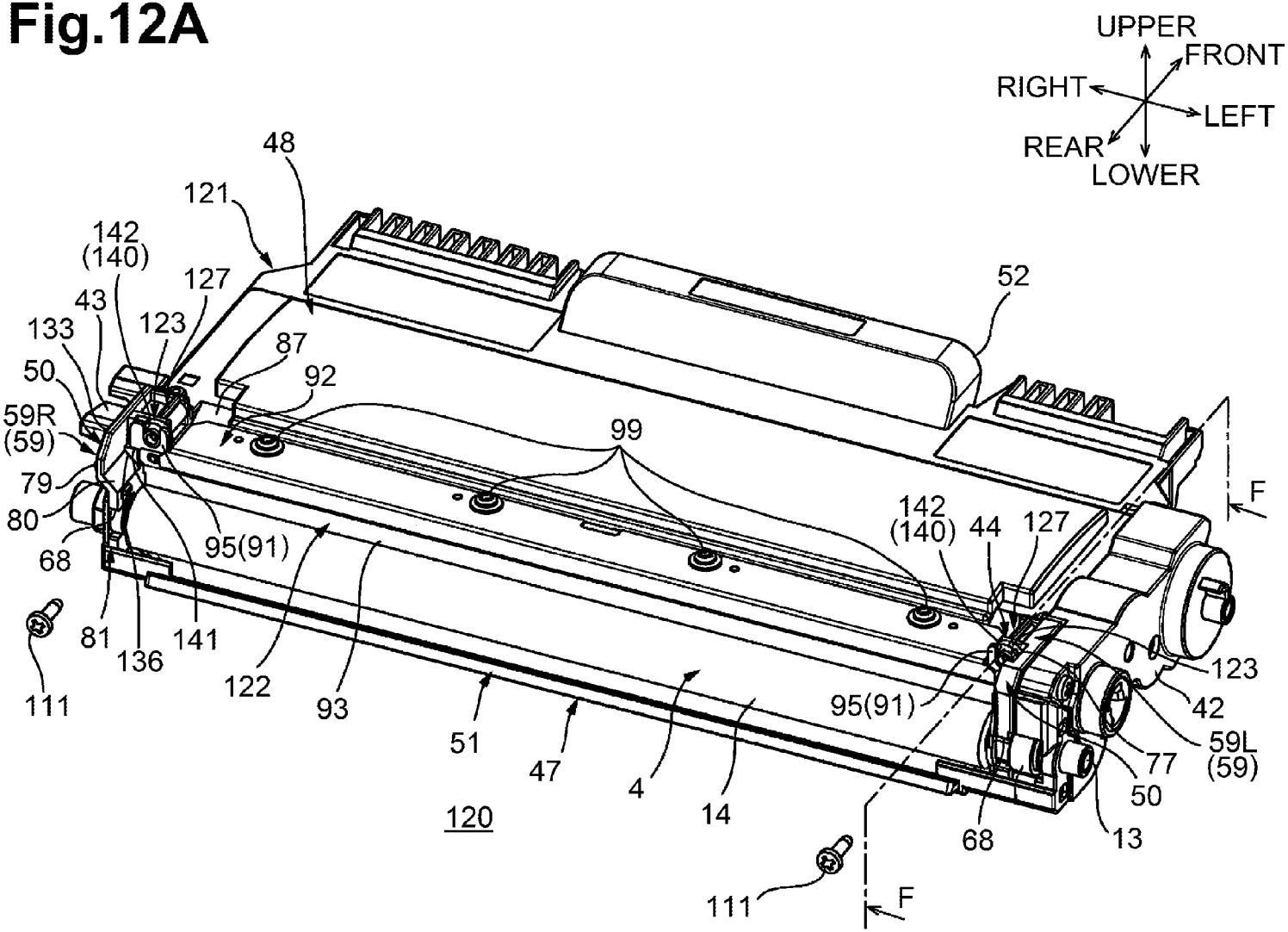
FIG. 12A is an explanatory diagram for describing attaching/detaching of the layer thickness regulating blade of the developing cartridge illustrated in FIG. 9A, illustrating a state where screws have been removed and the rotational spacers have been rotated.
Figure 12B:
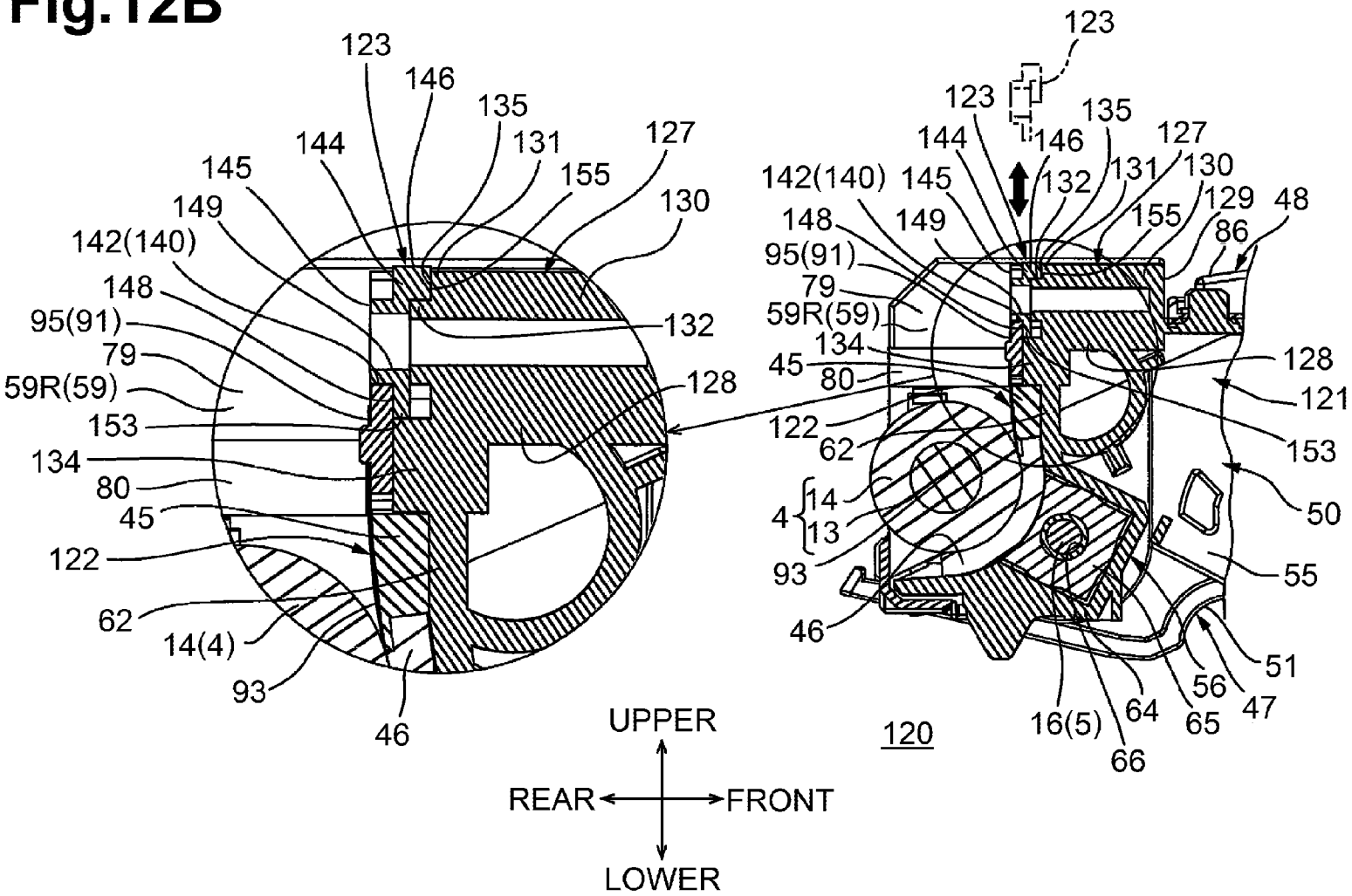
FIG. 12B is a cross-sectional view taken along line F-F in FIG. 12A.

Thus, the position of the first knob portion 152 moves from above the rotational spacer 123 to the left of the rotational spacer 123, and the position of the second knob portion 153 moves from the left of the rotational spacer 123 to below the rotational spacer 123, as illustrated in FIGS. 12A and 12B.

Accordingly, the rotational spacer 123 is rotated 180 degrees. Rotating the rotational spacer 123 180 degrees causes the inner perimeter face of the spacer half-ring portion 146 to come into contact with the outer perimeter face of the frame boss 132 at the upper portion thereof. The position of the rotational spacer 123 at this time is defined as a detachable position, where the rotational spacer 123 can be detached from between the developing frame 121 and the layer thickness regulating blade 122. That is to say, the rotational spacer 123 is moved by rotated from the detaching restriction position to the detachable position.

Figure 13A:
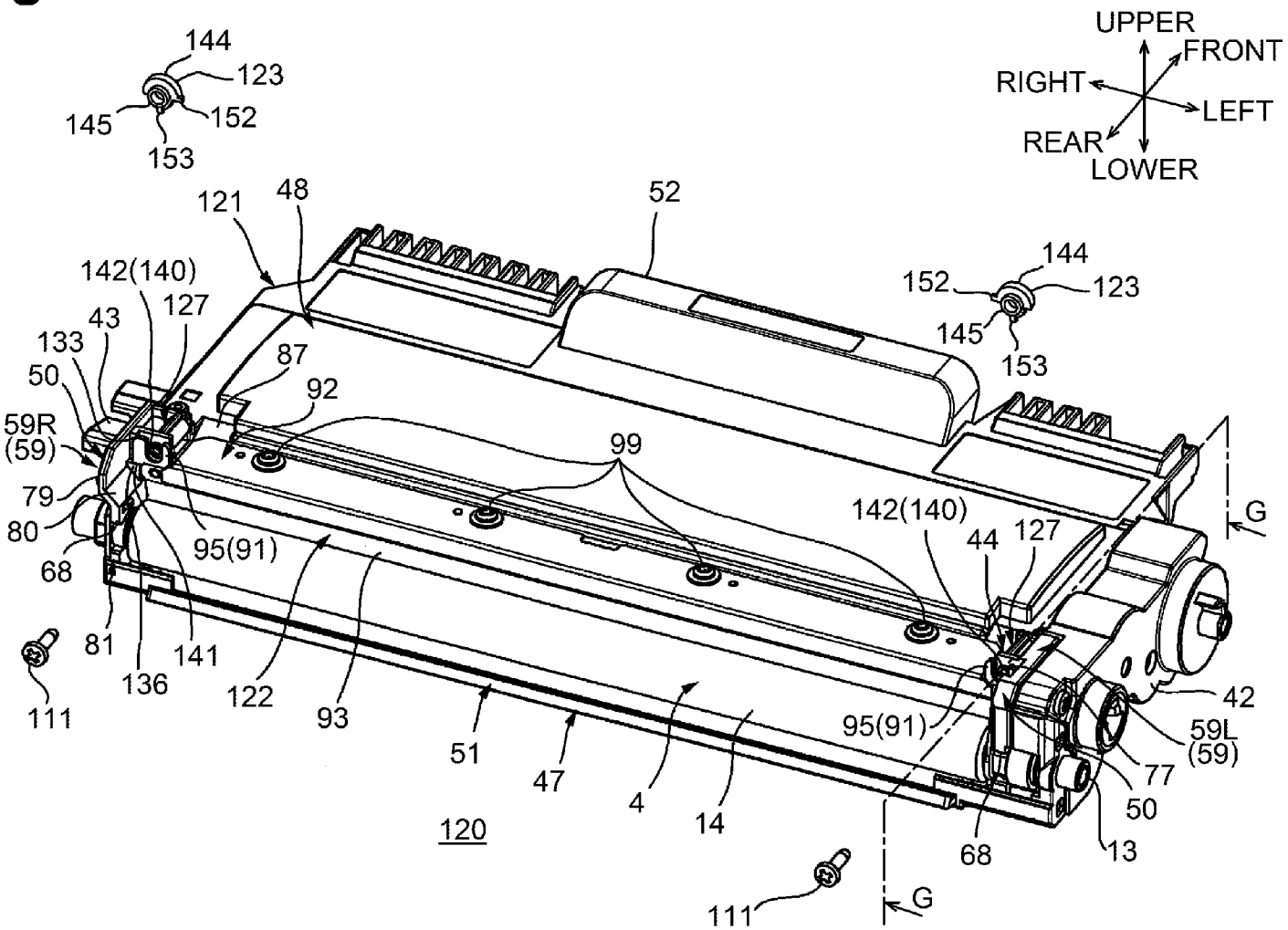
FIG. 13A is an explanatory diagram for describing attaching/detaching of the layer thickness regulating blade of the developing cartridge as a continuation from FIG. 12A, illustrating a state where the rotational spacers have been detached from the developing frame.
Figure 13B:
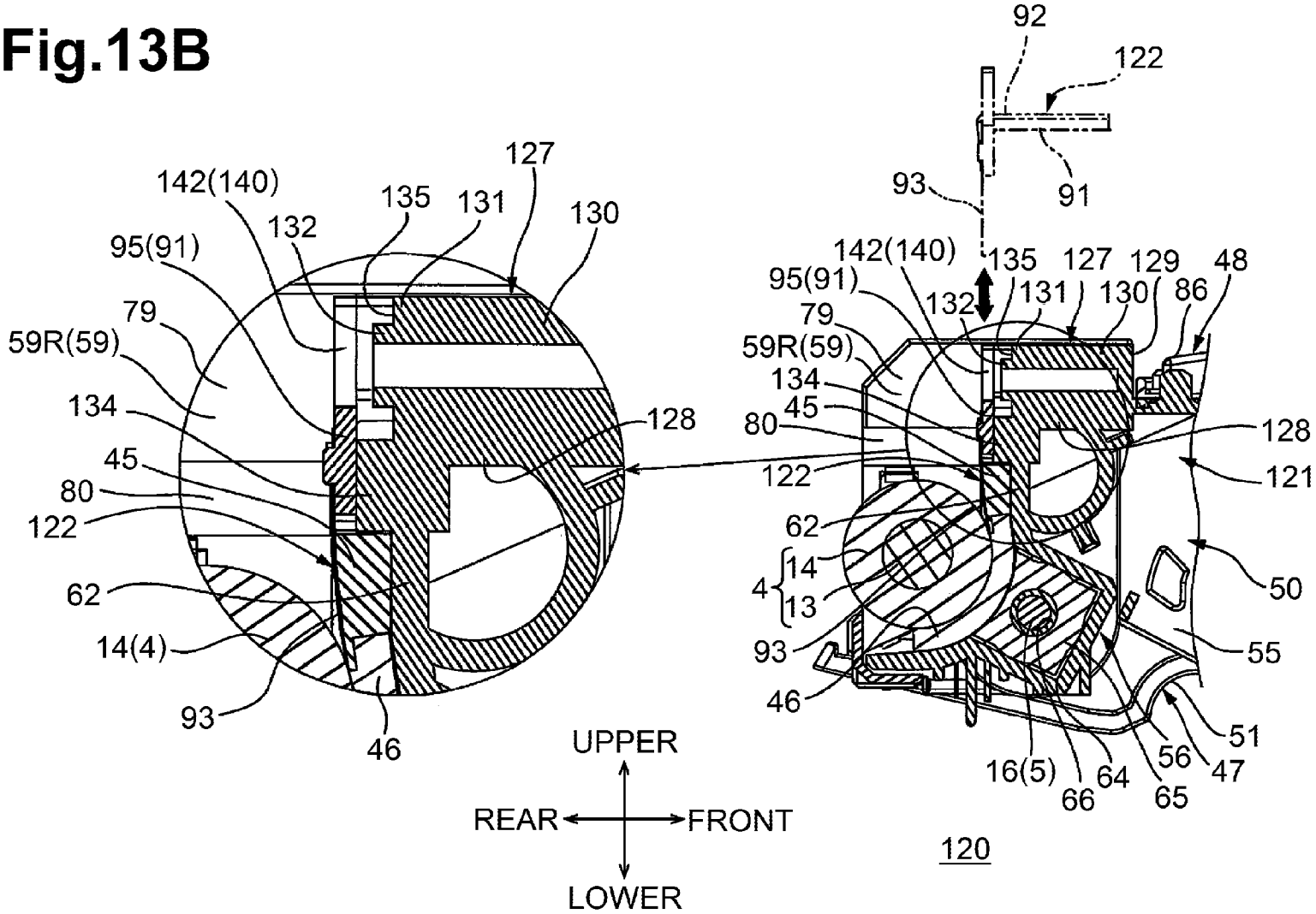
FIG. 13B is a cross-sectional view taken along line G-G in FIG. 13A.

Next, the rotational spacer 123 at the detachable position is moved upwards by the front face 155 of the spacer half-ring portion 146 sliding over the rear face 135 of the second extending portion 131, and the rear face 148 of the spacer disc portion 144 sliding over the front face of the clamping portion edge portion 95 of the layer thickness regulating blade 122, as illustrated in FIGS. 13A and 13B.

At this time, the spacer boss 145 of the rotational spacer 123 passes upwards through the receiving groove 140 of the clamping portion edge portion 95 of the first clamping member 91. This distances the outer perimeter face of the spacer boss 145 from the receiving groove 140 of the layer thickness regulating blade 122, and also the engagement between the first engaging portion 142 of the layer thickness regulating blade 122 and the rotational spacer 123 is released.

The rotational spacer 123 moving upwards as to the frame boss 132 of the spacer fixing portion 127 causes the inner perimeter face of the spacer half-ring portion 146 of the rotational spacer 123 and the outer perimeter face of the frame boss 132 to be distanced, and the engagement between the second engaging portion 154 of the rotational spacer 123 and the outer perimeter of the frame boss 132 is released.

The layer thickness regulating blade 122 is then moved upwards so as to be extracted from the developing frame 121 as indicated by the imaginary line in FIG. 13B and as illustrated in FIG. 10.

This completes detaching of the layer thickness regulating blade 122 from the developing frame 121.

(3-2) Mounting the Layer Thickness Regulating Blade According to the Second Embodiment The layer thickness regulating blade 122 is mounted to the developing frame 121 by performing the above-described procedures in reverse.

First, the layer thickness regulating blade 122 to the rear portion of the developing frame 121 from above, as illustrated in FIGS. 13A and 13B.

This brings the right abutting portion 141 of the first clamping member 91 of the layer thickness regulating blade 122 into contact with the upper face and left face of the positioning portion 136 of the right spacer fixing portion 127. Also, the left end portion of the first clamping member 91 of the layer thickness regulating blade 122 is situated within the notched groove 77, and though omitted from illustration the left abutting portion 141 of the first clamping member 91 is brought into contact with the bottom portion of the notched groove 77.

Also omitted from illustration is that the bottom portions of the four screws 99 of the layer thickness regulating blade 122 are accepted by corresponding screw accommodating portions 88, and the blade member 93 faces the rear face of the blade seal supporting portion 62 across the blade seal 45.

The layer thickness regulating blade 122 is thus positioned as to the housing.

And the bottom portion of the blade member 93 comes into contact with the top portion of the rubber roller 14 of the developing roller 4.

The two rotational spacers 123 are then inserted between the corresponding clamping portion edge portions 95 of the layer thickness regulating blade 122 and the corresponding spacer fixing portions 127, as illustrated in FIGS. 12A and 12B.

The operations of the right rotational spacer 123 will be described in the following description. The left rotational spacer 123 is attached by operations horizontally symmetrical to the right rotational spacer 123 so description thereof will be omitted.

At each of the two rotational spacers 123, the first knob portion 152 is situated on the inward side of the rotational spacer 123 in the left-right direction, and the second knob portion 153 is situated below the rotational spacer 123, as illustrated in FIGS. 13A and 13B.

The rotational spacer 123 moves downward with the front face 155 of the spacer half-ring portion 146 sliding over the rear face 135 of the spacer fixing portion 127, and the rear face 148 of the spacer disc portion 144 sliding over the front face of the clamping portion edge portions 95 of the layer thickness regulating blade 122.

At this time, the spacer boss 145 of the rotational spacer 123 passes downward through the receiving groove 140 of the clamping portion edge portions 95 of the first clamping member 91, so that the bottom portion of the outer perimeter face of the spacer boss 145 and the receiving groove 140 of the layer thickness regulating blade 122 come into contact, and the spacer boss 145 of the rotational spacer 123 and the first engaging portion 142 of the layer thickness regulating blade 122 are engaged.

The rotational spacer 123 is also assembled as to the frame boss 132 of the spacer fixing portion 127 from above, whereby the inner perimeter face of the spacer half-ring portion 146 of the rotational spacer 123 and the outer perimeter face of the top portion of the frame boss 132 come into contact. That is to say, the rotational spacer 123 is situated at the detachable position.

Next, the worker next holds the first knob portion 152 positioned to the left of the rotational spacer 123 situated at the detachable position, and rotates in the counterclockwise direction in rear view. The position of the first knob portion 152 thus moves from to the left of the rotational spacer 123 to above the rotational spacer 123, and the position of the second knob portion 153 moves from below the rotational spacer 123 to the left of the rotational spacer 123.

The worker then releases the first knob portion 152 and holds the second knob portion 153, and further rotates the rotational spacer 123 in the counter clockwise direction in rear view.

Thus, the position of the second knob portion 153 moves from the left of the rotational spacer 123 to above the rotational spacer 123, and the position of the first knob portion 152 moves from above the rotational spacer 123 to the right of the rotational spacer 123.

Accordingly, the rotational spacer 123 is rotated 180 degrees. Rotating the rotational spacer 123 180 degrees causes the inner perimeter face of the spacer half-ring portion 146 to come into contact with the outer perimeter face of the frame boss 132 at the lower portion thereof. The rotational spacer 123 is thus rotated and moved from the detachable position to the detaching restricting position, and the frame boss 132 is engaged with the second engaging portion 154 of the rotational spacer 123.

The screws 111 are then screwed to the spacer fixing portion 127 through the receiving grooves 140 of the layer thickness regulating blade 122 and the spacer holes 149 of the rotational spacers 123 as illustrated in FIGS. 9A and 9B, thus fixing the layer thickness regulating blade 122 to the developing frame 121.

This completes mounting of the layer thickness regulating blade 122 to the developing frame 121.

(4) Advantages of the Second Embodiment (4-1) According to the developing cartridge 120, the rotational spacers 123 are moved so that the spacer bosses 145 of the rotational spacers 123 pass through the receiving grooves 140 of the layer thickness regulating blade 122 as illustrated in FIGS. 10 and 12B, so the rotational spacers 123 can be easily mounted to and detached from the layer thickness regulating blade 122.

Consequently, the rotational spacers 123 alone can be easily mounted and detached with the layer thickness regulating blade 122 and developing roller 4 remaining assembled to the developing frame 121.

(4-2) Also, according to the developing cartridge 120, the rotational spacers 123 can be easily switched between a detachable position where detachable from between the developing frame 121 and layer thickness regulating blade 122, and a detaching restricting position where detaching from between the developing frame 121 and layer thickness regulating blade 122 is restricted, by rotating the rotational spacers 123, as illustrated in FIGS. 9B and 12B.

(4-3) According to the developing cartridge 120, the rotational spacers 123 can be easily rotated by using the first knob portion 152 and the second knob portion 153, as illustrated in FIGS. 9A and 13A.

What is claimed is:

1. A cartridge comprising:

a housing configured to accommodate a developing agent therein;

a developing agent carrying member configured to carry the developing agent;

a layer thickness restricting member disposed between the housing and the developing agent carrying member and comprising a blade supporting member and a blade, the blade supporting member being configured to support the blade and comprising a first engaging portion, the blade being configured to contact the developing agent carrying member to restrict a layer thickness of the developing agent carried by the developing agent carrying member;

a spacer disposed between the housing and the blade supporting member in a first direction in which the developing agent carrying member and the blade supporting member face one another and in which is orthogonal to a longitudinal direction of the developing agent carrying member, the spacer comprising—a first engaged portion configured to engage with the first engaging portion of the blade supporting member such that relative movement of the spacer and the blade supporting member is restricted in a second direction orthogonal to the first direction; and a fixing member, wherein the first engaging portion has a first through-hole penetrating the blade supporting member and the first engaged portion has a second through-hole penetrating the spacer, and the first engaged portion, having the second through-hole, of the spacer is inserted in the first through-hole of the first engaging portion of the blade supporting member, and wherein the fixing member extends through the first through-hole and the second through-hole and fixes the blade supporting member to the housing.

2. The cartridge according to claim 1, wherein the housing comprises a second engaged portion, and wherein the spacer comprises a second engaging portion configured to engage with the second engaged portion.

3. The cartridge according to claim 2, wherein a part of the second engaging portion of the spacer is notched out in a direction orthogonal to the first direction such that the second engaged portion passes through.

4. The cartridge according to claim 1, wherein a part of the first engaging portion of the blade supporting member is notched out in a direction orthogonal to the first direction such that the first engaged portion passes through.

5. The cartridge according to claim 1, further comprising a seal member disposed between the housing and the blade supporting member, at a different position from a position where the spacer is disposed.

6. The cartridge according to claim 5, wherein the housing further includes a fixing portion configured to fix the spacer; and wherein an end portion of the seal member toward the blade supporting member in the first direction is disposed closer to the blade supporting member than an end portion of the fixing portion toward the blade supporting member in the first direction.

7. A cartridge comprising:

a housing configured to accommodate a developing agent therein;

a developing agent carrying member configured to carry the developing agent;

a layer thickness restricting member disposed between the housing and the developing agent carrying member and configured to restrict a layer thickness of the developing agent carried by the developing agent carrying member; and a spacer disposed between the housing and the layer thickness restricting member in a first direction in which the developing agent carrying member and the layer thickness restricting member face one another and in which is orthogonal to a longitudinal direction of the developing agent carrying member, wherein the spacer comprises a first engaged portion, wherein the layer thickness restricting member comprises a first engaging portion configured to engage with the first engaged portion such that relative movement of the spacer and the layer thickness restricting member is restricted in a second direction orthogonal to the first direction, and wherein the spacer is configured to be rotatably movable between a detachable position, where the spacer is detachable from between the housing and the layer thickness restricting member, and a detaching restrict position, where the spacer is restricted from being detached from between the housing and the layer thickness restricting member, in view from the first direction.

8. The cartridge according to claim 7, wherein the spacer comprises a knob portion configured to rotate the spacer.

9. The cartridge according to claim 1, wherein the spacer is generally formed as a square column.

10. The cartridge according to claim 9, wherein when the spacer is disposed between the housing and the blade supporting member, a surface of the spacer in the first direction and a surface of the blade supporting member in a direction that the blade supporting member extends make an angle of about 90 degrees.

11. The cartridge according to claim 1, wherein when the spacer is not disposed between the housing and the blade supporting member, blade supporting member is movable in the first direction.

12. The cartridge according to claim 1, wherein the first engaged portion is configured to protrude toward the blade supporting member in the first direction.

13. The cartridge according to claim 2, wherein the second engaged portion is configured to protrude toward the spacer in the first direction.

14. The cartridge according to claim 1, wherein the blade supporting member is configured to support the blade by clamping the blade.

15. The cartridge according to claim 7, wherein the housing comprises a second engaged portion, and wherein the spacer comprises a second engaging portion configured to engage with the second engaged portion.

16. The cartridge according to claim 15, wherein a part of the second engaging portion of the spacer is notched out in a direction orthogonal to the first direction such that the second engaged portion passes through.

17. The cartridge according to claim 15, wherein the second engaged portion is configured to protrude toward the spacer in the first direction.

* * * * *